US012685395B2

(12) United States Patent
Szpyt

(10) Patent No.: US 12,685,395 B2
(45) Date of Patent: Jul. 21, 2026

(54) ADJUSTABLE BASE ELEMENT FOR FURNITURE FOR LYING ON, AND FURNITURE FOR LYING ON

(71) Applicant: BETT1.DE GMBH, Berlin (DE)

(72) Inventor: Adam Roman Szpyt, Berlin (DE)

(73) Assignee: BETT1.DE GMBH, Berlin (DE)

( * ) Notice: Subject to any disclaimer, the term of this patent is extended or adjusted under 35 U.S.C. 154(b) by 323 days.

(21) Appl. No.: 18/248,316

(22) PCT Filed: Oct. 8, 2021

(86) PCT No.: PCT/EP2021/077934
§ 371 (c)(1),
(2) Date: Apr. 7, 2023

(87) PCT Pub. No.: WO2022/074231
PCT Pub. Date: Apr. 14, 2022

(65) Prior Publication Data

US 2024/0260760 A1 Aug. 8, 2024

(30) Foreign Application Priority Data

Oct. 9, 2020 (EP) ..... 20201189

(51) Int. Cl.
*A47C 20/04* (2006.01)
*A47C 20/08* (2006.01)
(Continued)

(52) U.S. Cl.
CPC ..... *A47C 20/041* (2013.01); *A47C 21/026* (2013.01); *A47C 27/003* (2013.01);
(Continued)

(58) Field of Classification Search
CPC ... A47C 20/041; A47C 21/026; A47C 27/003; A47C 27/005; A47C 31/008;
(Continued)

(56) References Cited

U.S. PATENT DOCUMENTS 10,463,162 B2 11/2019 Dewert
2005/0055779 A1* 3/2005 Damewood ..... A47C 27/001 5/722

(Continued)

FOREIGN PATENT DOCUMENTS

CN 2817623 Y 9/2006
CN 106108492 A 11/2016

(Continued)

OTHER PUBLICATIONS

"Open-Cell." Glossary of Foam Industry Terms, Foam Factory, Oct. 6, 2020 www.foambymail.com/glossary.html?srsltid=AfmBOorLPWOj6zYehY4Dr304Cq1dncqiUulMJbrO6O0uob1m4B5iYLSP (Year: 2020).*

(Continued)

*Primary Examiner* — Madison Matthews
(74) *Attorney, Agent, or Firm* — Oblon, McClelland, Maier & Neustadt, L.L.P.

(57) ABSTRACT

A base element and a reclining furniture including a base element and mattress are proposed. The base element includes a frame element formed at least partially of elastically deformable material, which comprises a compartment. The base element further comprises an at least partially elastically deformable cover layer, wherein the cover layer is arranged on the second side of the frame element so that the compartment is at least partially bounded by the cover layer, and wherein the cover layer forms a support surface for a mattress arranged opposite the bottom surface. Furthermore, an adjustment device is provided, which is at least partially arranged in the compartment of the frame element, wherein the adjustment device comprises at least one drive as well as a drive mechanism coupled to the drive and is configured to deform the base element and/or a mattress placed on the base element at least in certain areas.

22 Claims, 8 Drawing Sheets

(51) Int. Cl.
*A47C 21/02* (2006.01)
*A47C 27/00* (2006.01)
*A47C 31/00* (2006.01)

(52) U.S. Cl.
CPC ..... *A47C 27/005* (2013.01); *A47C 31/008* (2013.01); *A47C 20/08* (2013.01)

(58) Field of Classification Search
CPC ..... A47C 20/08; A47C 27/05; A47C 27/06; A47C 27/002; A61G 7/015
USPC ..... 5/618, 613, 616, 722
See application file for complete search history.

(56) References Cited

U.S. PATENT DOCUMENTS

| | | | | |
|---|---|---|---|---|
| 2015/0182397 | A1* | 7/2015 | Palashewski | A47C 20/08 5/616 |
| 2017/0258239 | A1* | 9/2017 | Xie | A47C 27/002 |
| 2017/0332798 | A1 | 11/2017 | Dewert | |
| 2018/0168358 | A1* | 6/2018 | Dewert | A47C 20/041 |
| 2018/0325267 | A1 | 11/2018 | Dewert | |
| 2018/0325268 | A1 | 11/2018 | Dewert | |
| 2018/0344049 | A1* | 12/2018 | Szpyt | D04B 1/22 |
| 2019/0008284 | A1* | 1/2019 | Gehrke | A61G 7/015 |
| 2020/0163464 | A1 | 5/2020 | Dewert | |

FOREIGN PATENT DOCUMENTS

| | | | | |
|---|---|---|---|---|
| CN | 107072405 | A | 8/2017 | |
| CN | 108851743 | A | 11/2018 | |
| DE | 202010005375 | U * | 10/2011 | A47C 20/04 |
| DE | 20 2020 104 776 | U1 | 10/2020 | |
| EP | 1410743 | A2 * | 4/2004 | A47C 20/041 |

OTHER PUBLICATIONS

English translation of International Preliminary Report on Patentability and Written Opinion issued Apr. 20, 2023 in PCT/EP2021/077934, 11 pages.
International Search Report issued Mar. 23, 2022 in PCT/EP2021/077934 filed on Oct. 8, 2021, 3 pages.
Combined Chinese Office Action and Search Report issued Aug. 16, 2025 in Chinese Patent Application No. 202180077777.6, 11 pages.

* cited by examiner

ADJUSTABLE BASE ELEMENT FOR FURNITURE FOR LYING ON, AND FURNITURE FOR LYING ON

TECHNICAL AREA

The disclosure relates in general to the field of reclining furniture and/or sleeping furniture. In particular, the disclosure relates to a base element for a reclining furniture which is deformable and/or adjustable at least in certain areas, and to a reclining furniture comprising such a base element and a mattress.

TECHNICAL BACKGROUND

Reclining furniture has been used for some time as a support and/or reclining surface for a user and has been constantly being developed further, particularly with regard to reclining comfort for the user and ergonomic reclining for the user. Typically, reclining furniture is adapted to special requirements.

For example, there is reclining furniture for outdoor use, such as in the form of garden furniture or the like, which usually provides a foam pad or cushion for the user to lie on. Such bases are regularly uncomfortable and do not adequately meet the requirements in terms of reclining comfort and ergonomic reclining. In addition, such reclining furniture is usually only adjustable to a limited extent, so that a user has few options for changing his or her reclining position.

In addition, reclining furniture is used in different variants as sleeping furniture, armchairs, couches or the like in the interior. Such reclining furniture usually has an upholstery or a mattress. To improve lying comfort, mattresses can be formed, for example, with zones, areas and/or support areas of different hardness, compressibility, compression hardness and/or elasticity adjoining one another in the longitudinal direction of the mattress, for example in order to adapt a penetration depth of the user lying on the mattress to the user's body shape. In this way, it can be achieved, for example, that the user lies on the mattress in the side position with a spine that is as straight as possible. The same applies in the supine position, where the spine should be supported in such a way that it comprises the natural S-shape. By providing several support areas of different hardness and/or different degrees of hardness, it is also possible to advantageously take into account a weight distribution of the user and thus ensure an ergonomic posture of the user, for example in several sleeping positions or sleeping postures of the user.

Known reclining furniture is therefore usually only designed, configured and suitable for special applications, such as indoor or outdoor use. In addition, known reclining furniture often does not meet the requirements in terms of reclining comfort, ergonomic reclining and/or adaptability to individual needs.

SUMMARY

Embodiments of the disclosure can advantageously provide an improved base element for a reclining furniture as well as an improved reclining furniture.

This achieved in particular by the subject matter of the independent claims. Advantageous embodiments and further developments are included in the dependent claims and in the following description.

One aspect of the present disclosure relates to a base element configured to deform and/or adjust a reclining furniture and/or a mattress placed or arranged on the base element at least in one or more parts, portions, areas and/or sections of the mattress. For example, the base element may be configured to support and/or deform a mattress at least in one or more sections. The base element comprises a frame element which is formed at least partially from elastically deformable material, in particular at least partially from foam material, viscose foam, polyurethane foam or the like, and which has a bottom surface on a first side, for example a first longitudinal side, and has a second side opposite the first side. The frame element comprises a compartment on the second side. The base element further comprises an at least partially elastically deformable cover layer. The cover layer is arranged on the second side of the frame element such that the compartment is at least partially bounded, defined, covered, and/or closed by the cover layer. In addition, the cover layer forms a support surface of the base element arranged opposite the bottom surface for supporting a mattress. The base element further comprises an adjustment device, which is arranged and/or accommodated at least partially in the compartment of the frame element. The adjustment device comprises at least one drive as well as a drive mechanism coupled to the drive, in particular mechanically and/or electrically coupled, and is configured to deform, displace and/or adjust the base element and/or a mattress placed on the base element at least in areas, parts, portions and/or sections. The drive mechanism comprises at least two rails, which are arranged substantially parallel to a longitudinal axis of the base element and which are spaced apart from and/or coupled to one another parallel to a transverse axis of the base element by at least one transverse strut, which extends parallel to the transverse axis and/or transversely to the longitudinal axis of the base element. Thereby, each of the at least two rails comprises at least two rail elements, which are arranged one behind the other parallel to the longitudinal direction of the base element and are coupled to each other via at least one joint and/or a joint connection, so that the at least two rail elements of each rail are displaceable, pivotable and/or tiltable relative to each other via the at least one drive.

By displacing and/or pivoting the rail elements of the rails, the reclining furniture, the mattress and/or the base element can be deformed, deformed and/or moved, in particular in such a way that a reclining position can be variably and/or changeably adjusted for a user.

In the frame element, the adjustment device can be accommodated in a protected manner and an adjustment or deformation of the base element can be made possible. This can enable an adjustment of one or more sections and/or areas (or reclining areas) of a mattress and/or the reclining furniture placed on the base element as required, as explained in detail below.

The reclining furniture, in the context of the present disclosure, may refer to any type of reclining furniture, such as a sleeping furniture, an armchair, a couch, a bed furniture, a bed, a couch or the like.

The frame element can basically be any structure that is partially or completely formed from an elastically deformable material. In particular, the frame element can be formed partially or completely from foam, viscoelastic foam, polyurethane foam or the like.

The frame element and the compartment formed therein can form a frame for the adjustment device. For example, the frame element and/or the compartment can be formed in such a way that the adjustment device is surrounded and/or enclosed by the frame element on the underside and on all four flanks. The adjustment device can thus be integrated, accommodated and/or arranged in the frame element. This means that the adjustment device can be protected against mechanical damage and/or further environmental influences, such as water or moisture penetration.

In the context of the present disclosure, the compartment may denote a chamber, a space, an opening, a recess, and/or a depression. Conceivably, the compartment comprises substantially the same width, height, and depth as the adjustment device, such that the adjustment device is supported on one or more flanks by the frame element and/or within the compartment. In this way, movements of the adjustment device can be minimized and the adjustment device can be cushioned and/or protected by the frame element.

The first side of the frame element comprises a floor surface. The floor surface can be used to rest and/or support the base element and/or the reclining furniture on the floor.

The adjustment device can be a motorized adjustment structure or adjustment arrangement, which is configured to adjust, move, pivot and/or displace the at least two rail elements of at least one of the at least two rails relative to each other via the at least one drive and the at least one drive mechanism. In particular, the rail elements of one, several or each rail can thereby be displaced about an axis parallel to the transverse axis of the base element and/or parallel to the at least one transverse strut and/or transverse to the longitudinal direction of the base element. A region of the base element between rail elements of the rails lying opposite each other in pairs (in the transverse direction of the base element) can thus be displaced and/or adjusted relative to a further region of the base element, for example between further rail elements of the rails lying opposite each other in pairs (in the transverse direction of the base element), for example about an axis parallel to the transverse axis of the base element.

The at least two rails of the adjustment device together with the at least one transverse strut may, for example, form the structure or shape of an H and/or a ladder, wherein the two legs of the H-shape may be formed by the at least two rails and a position of the transverse strut is arbitrary.

The drive can basically be any type of electric drive and/or electric motor. The drive can be supplied with power via an energy storage device and/or a power cable. A supply via solar cells, photovoltaics and/or energy harvesting is also conceivable.

Alternatively or additionally, the drive can be inductively supplied with electrical energy. For example, the base element may comprise one or more inductive receivers, such as one or more receiving coils, which can be inductively coupled to an external inductive supply device.

The cover layer can generally designate a layer of elastically deformable material, which can be arranged on the frame element. The cover layer may be made of the same material as the frame element or of different materials. In particular, the top layer may be formed from a foam material, a foam, a viscoelastic foam, polyurethane foam or the like.

In particular, the cover layer can be dimensioned and formed in such a way that it at least substantially limits and/or closes off the compartment. Essentially can mean here that, for example, one or more reach-through options can be provided so that a user can reach components of the adjustment device. However, the compartment may also be completely bounded and/or closed off by the cover layer on the second side of the frame element. Similarly, the compartment may be bounded by the frame element and the cover layer. The cover layer can generally protect the adjustment device from external influences or impacts.

In particular, the cover layer can have a base area that is substantially identical relative to the frame element and/or a plan view that is substantially identical relative to the frame element, so that the cover layer can be placed, arranged and/or supported on the frame element over almost the entire surface area and/or flush with the frame element.

The thickness of the top layer can be constant over its area or variable. For example, the top layer in the area of the compartment can have a different thickness compared to other areas of the top layer, such as a greater thickness.

According to an embodiment, the base element adjustment device further comprises a control circuitry configured to actuate and/or control the drive. In particular, the control circuitry may be configured to regulate, control and/or monitor a direction of rotation and/or a speed of rotation of the drive. For example, this can be used to regulate and/or control a direction of movement and/or speed with which the rail elements, the rails, the base element and/or a mattress placed thereon are adjusted, moved, pivoted and/or displaced.

The control circuitry may generally be a control circuit, control unit, a controller, and/or a control component. The control circuitry may, for example, comprise one or more microcontrollers and/or processors. The control circuitry may be arranged in a housing with the drive and/or other components, or it may be arranged in a separate housing. The control circuitry can be wirelessly or wired coupled to the drive of the adjustment device. Alternatively or additionally, the control circuitry can also be integrated and/or arranged in one of the rails. Particularly in the case of a waterproof or watertight design of the base element or at least a part thereof, a communication link between the drive and the control circuitry can be established via a cable.

Optionally, the control circuitry can comprise a housing, in particular a waterproof and/or hermetically sealed housing. This allows the control circuitry and/or its electronics to be protected against environmental influences, such as water, moisture or mechanical influences.

The adjustment device and/or the control circuitry can optionally comprising a data memory in which one or more predefined positions of the rail elements relative to each other can be stored.

According to an embodiment, the adjustment device of the base element is configured to be at least partially watertight and/or hermetically sealed. All or some of the components or elements, in particular the drive and/or the drive mechanism, of the adjustment device can be configured to be watertight. In particular, optionally existing connections between the control circuitry and the drive, between the drive and the drive mechanism, and/or between the drive and an optional power supply may be configured to be waterproof. An at least partially waterproof design of the adjustment device can in particular enable use of the base element outdoors or in humid environments or environments with punishing environmental influences, such as in swimming pools, at the beach, in lounges, in clubs, in public institutions, or the like.

For example, one or more optional cables, such as a power supply cable and/or a cable between the drive and the control circuitry, may be insulated with a protective waterproof sheath. Alternatively or additionally, cable connections may be configured to be waterproof.

Alternatively or additionally, one or more cable feedthroughs between components of the adjustment device and/or the base element can be configured to be watertight.

For example, at least one sealing element can be provided on at least one cable feedthrough for this purpose, which sealingly encloses the cable guided through the cable feedthrough at least along part of an outer circumference of the cable. Alternatively or additionally, one or more cable bushings can be mechanically reinforced, for example by an eyelet.

Alternatively or additionally, the control circuitry, the drive and/or the drive mechanics can be housed in one or more housings in a protected, in particular waterproof, manner.

It is conceivable that each component, i.e. mechanical or electronic component, of the adjustment device is arranged in a separate housing or that some components are arranged in a common housing. Such a housing can be multi-piece or one-piece. In the case of a multi-piece housing, for example, the different parts or pieces of the housing may be connected to each other with waterproof seals. Also, cable penetrations into the respective housing may be provided with one or more seals, injection molded, poured, and/or glued.

According to an embodiment, the adjustment device further comprises one or more energy storage devices configured to at least partially supply the adjustment device with electrical energy. The at least one energy storage device can in principle be any energy storage device, such as an accumulator, a battery, a capacitor or the like. In particular, the at least one energy storage device can be designed to supply the adjustment device with electrical energy for a certain period of time in an energy-autonomous manner. This can enable flexible use of the base element at any location.

The at least one energy storage device can be characterized in particular by one or more of the following properties: a low self-discharge, short-circuit protection, overcurrent shutdown, deep discharge protection, acoustic warning in the event of a low residual charge, optical charge status display, LED charge indicator to indicate a charge status, mounting feet, a capacity of at least 1000 mAh, for example 1800 mAh, a short charging time and a low weight (e.g. between 300 and 1500 grams, in particular around 500 grams). The energy storage device may be adapted to the adjustment device with its power specifications.

It is also possible to change the energy storage device as required. The at least one energy storage device can be charged by cable, for example. Alternatively or additionally, the energy store can also be charged inductively, by energy harvesting and/or by means of solar cells.

For example, the base element may comprise one or more inductive receivers, such as one or more receiving coils, which may be inductively coupled to an external inductive supply device to charge the energy storage device.

Optionally, the energy storage device may be housed in one or more housings, in particular a waterproof and/or hermetically sealed housing.

According to an embodiment, the adjustment device comprises several drives and/or several drive mechanisms. For example, it can be provided that for one or more pairs of rail elements of the at least two shams that are opposite each other in the transverse direction of the base element, at least one drive and at least one drive mechanism is provided in each case. This can enable pivoting and/or displacement in pairs with the force required for this. Also, in this way, the individual areas between rail elements opposing each other in pairs can be flexibly displaced relative to each other as required, so that a lying position can be individually adjusted. The use of multiple drives and/or drive mechanisms can also increase a load capacity of the adjustment device. For example, when using one or more drives/drive mechanisms, the adjustment device can withstand loads of at least 80 kg, at least 100 kg, at least 150 kg, at least 30 kg or more.

The adjustment device and/or a control circuitry are designed in particular for stepless adjustment of the rail elements, the base element and/or the reclining furniture. For example, rail elements that are adjacent to one another in the longitudinal direction and are each connected via a joint can be pivoted by at least 50°, at least 60°, at least 70°, at least 80°, at least 90°, at least 120° or more (about an axis parallel to the transverse axis of the reclining furniture and/or base element).

According to an embodiment, the adjustment device comprises at least one interface and/or communication interface configured to receive and/or transmit a control signal. The at least one drive is further configured to deform the base element and/or a mattress placed on the base element based on the control signal at least in certain areas, for example in one or more areas of the base element between rail elements lying opposite each other in pairs in the transverse direction. Alternatively or additionally, the control circuitry is configured to control the drive based on the control signal, to actuate it, to set a direction of rotation, to set a rotational speed and/or an angle of rotation.

The control signal may comprise and/or correlate with information regarding a direction of rotation, an angle of rotation, a height, a speed of rotation, a position and/or shape of the base element which should achieve the adjustment device. Thus, a user of the base element or of a reclining furniture with such a base element can deform the mattress, which may be placed on the base element, according to his or her needs and individually.

The interface can basically be any interface that allows a user to send or receive a control signal in any way. The at least one interface may be wired or wireless. For example, the at least one interface may be configured to connect a user interface, a smartphone, a tablet, a PC, a server, or the like. For example, the at least one interface may establish a bus connection, a cellular connection, a WLAN connection, an Internet connection, a Bluetooth connection, a radio connection, an optical connection, a cable connection, or any other connection(s) with one or more further devices. In particular, the interface can be configured to receive a control signal from the operating device and/or a control circuitry of the base element or reclining furniture.

According to an embodiment, the at least one interface is a wireless interface configured to receive and/or transmit a control signal wirelessly. For example, the interface can be configured to communicate with a smartphone or similar data processing device, such as a tablet or the like, and the adjustment device can be controlled and/or actuated via an app installed there.

According to an embodiment, the base element further comprises an operating device configured to send and/or receive a control signal wirelessly and/or via cable to the adjustment device, the at least one drive and/or a control circuitry of the adjustment device. The control device can function as a type of wired and/or wireless remote control and enable convenient operation and/or actuation of the adjustment device for the user. In particular, in the case of a waterproof or water-resistant design of the base element or at least a part thereof, a communication link between the operating device and the adjustment device, the at least one drive and/or the control circuitry can be established via a cable.

The operating device can basically be any device that can be used by a user to send or receive a control signal. This can be a smartphone, a tablet, a remote control or the like. The sending of a control signal may be, for example, via button press, gesture control, via a display, or via a voice command from a user. The control device may be connected to the base element via cable and/or wirelessly. In this case, the connection to the operating device can be waterproof. The operating device itself may also be waterproof. The control signal can alternatively or additionally be sent or received wirelessly, for example via a mobile radio interface of the operating device. Remote control via the Internet, for example via an app or a web interface, is also conceivable.

According to an embodiment, the drive mechanism coupled to the at least one drive comprises a cable pull mechanism and/or a gear mechanism. The drive mechanism can be at least partially, in particular completely, accommodated, integrated and/or arranged in one or more rail elements and/or the at least one cross strut. This allows a compact design and protection of the adjustment device. Alternatively or additionally, the drive mechanism can be at least partially accommodated in a housing.

The rails and/or the rail elements can in particular be made of a robust material, such as plastic, fiber-reinforced plastic, metal, wood or the like.

According to an embodiment, at least one longitudinal support strut is arranged on each of the least two rails for extending the respective rail. For example, a longitudinal support strut may be arranged at one or both ends of the rails, such as a head end and/or a foot end of each rail. The longitudinal support struts may thereby be formed of the same or a different material as the rails, such as plastic, fiber-reinforced plastic, metal, wood. In particular, a design made of wood can be advantageous.

Via the longitudinal support struts, the surface area of one or more areas of the base element and/or of a mattress placed thereon can be increased in the longitudinal direction of the base element in an advantageous manner, since in each case areas can be displaced between longitudinal support struts that are opposite each other in pairs in the transverse direction.

The longitudinal support struts can be mechanically connected and/or coupled to the respective rail or rail element. Plug-in, press-fit and/or snap connections are conceivable, but other connections such as bolts, screws and/or adhesive connections are also possible.

According to an embodiment, an intermediate layer is arranged between each of the rails and the frame element, the bottom surface and/or the top layer of the frame element, such that the rails and the frame element, the bottom surface and/or the top layer are separated from each other by the intermediate layer. The intermediate layer can comprise any material, for example textile material, fabric, cloth, plastic, plastic or other materials. The intermediate layer can advantageously protect the frame element against influences from the rails. For example, if the rails are made of wood and the frame element is made of foam, the foam can be affected by contact with the wood and become porous, for example. Such material impairments can be efficiently avoided by the intermediate layer.

The intermediate layer may designate a separate material layer or ply. Alternatively or additionally, the intermediate layer may denote an outer material layer, a paint and/or a coating of the rails, the frame element, the bottom surface and/or the top layer of the frame element. For example, the intermediate layer may be in the form of a varnish or the like applied to the frame element, the rails, the top layer, and/or the bottom surface. Alternatively or additionally, the intermediate layer may denote an adhesive layer. For example, the rails may be at least partially bonded to the frame element, and the bond between the frame element and the rails may form the intermediate layer.

According to an embodiment, the longitudinal support struts arranged on each of the two rails are coupled to and/or spaced apart from each other via at least one transverse support strut. As a result, the areas between longitudinal support struts that are opposite each other in pairs in the transverse direction can be supported by the at least one transverse support strut. Several transverse support struts can also be provided per region.

According to an embodiment, the at least one drive mechanism is arranged on one of the at least two rails and coupled via at least one shaft to at least one further rail arranged opposite. For example, the drive mechanism may comprise the shaft and at least one drive mechanism may be arranged in each rail, such as a gear and/or pulley mechanism. The drive mechanism may actuate one of the drive mechanisms in one of the rails, and rotation of the drive mechanism may be transmitted to the drive mechanism located in the oppositely arranged rail via the shaft. In this way, both rails or rail elements of both rails can be moved by only one motor or drive. In particular, this can enable a compact and lightweight design of the base element.

According to an embodiment, each of the at least two rails comprises at least three rail elements which are arranged one behind the other parallel to the longitudinal direction and are coupled to each other in pairs via at least one joint, so that the base element is deformable, movable and/or displaceable in at least three partial areas which may be formed between rail elements opposing each other in pairs in the transverse direction. Also, one or two further areas at one or both front ends of the base element can be displaced in this way, although no rails may be arranged there.

According to an embodiment, the base element further comprises at least one base cover and/or intermediate cover which encloses the base element at least partially, in particular completely, and which is configured in particular to prevent a mattress placed on the base element from slipping. The base cover can be made of any material and/or fabric, in particular natural fiber, synthetic fiber or a mixture thereof. The base cover can also serve to protect the base element.

Optionally, the base cover may also be at least partially waterproof, such as on the bottom, sides, and/or top. For example, the base cover may comprise one or more water-repellent, water-resistant, and/or waterproof layers, such as made of rubber material, latex, a polymer-based material, or other suitable material.

According to an embodiment, the base cover is at least partially formed from a rubber-like material. Alternatively or additionally, the base cover is at least partially rubberized. Alternatively or complementarily, the base cover is formed at least partially of latex. In particular, an upper side, on which a mattress can be placed, and/or an underside for placing the base element on the floor or a supporting surface, can be at least partially rubberized, coated, and/or provided with latex, for example to prevent a mattress from slipping and/or to prevent or counteract penetration of water or moisture.

According to an embodiment, the base cover comprises an at least partially circumferential closure, in particular a zipper, to be opened and/or closed for insertion and/or removal of the base element. Optionally, the zipper may be at least partially waterproof to prevent or counteract the ingress of water or moisture.

Another aspect of the present disclosure relates to a reclining furniture having a base element as described above and below. All of the foregoing and following disclosure with respect to the base element applies equally to the reclining furniture and vice versa. The reclining furniture further comprises a mattress, which is laid and/or arranged with a first side on the cover layer of the base element, so that the mattress can be deformed, displaced and/or adjusted at least in certain areas by deforming the base element at least in certain areas by means of the adjustment device, and wherein the mattress comprises a second side opposite the first side, which second side forms a reclining surface of the reclining furniture. The mattress can be arranged and/or placed on the base element in such a way that the mattress is moved and/or displaced in areas corresponding to and/or in accordance with and/or in response to a movement of the base element.

In this way, one or more areas or lying areas (also referred to herein as supporting areas or portions) of the mattress, which can be arranged above the rail elements opposite each other in pairs in the transverse direction and/or at one or both head ends, can be individually adjusted and/or adjusted in terms of position, relative position, angle between the areas and/or height, in particular continuously. This can provide significant comfort to a user by allowing them to vary their position as needed. Also, this increases the versatility of the reclining furniture, which can therefore be used equally advantageously for indoor and outdoor purposes. Also, the reclining furniture can be variably adapted to special requirements, such as a lounge chair, a pool chair, a bed, a garden furniture, a couch, a sleeping furniture or the like.

Furthermore, the modular design of the reclining furniture can advantageously allow parts, such as the base element and the mattress, to be transported separately. On the one hand, this can considerably simplify delivery to customers, return shipment and transport to different locations by the user. The range of uses for the reclining furniture can also be further increased, for example by enabling the use of different types of mattresses.

According to an embodiment, the reclining furniture further comprises at least one reclining furniture cover which encloses the base element and the mattress at least partially, in particular completely. With the couch cover, the mattress and the base element can be held together mechanically in an advantageous manner in order to prevent the mattress from slipping on the base element.

Alternatively or additionally, it is also possible to connect the base element and the mattress to one another, for example by means of press studs, a Velcro fastener arranged at least in certain areas on the upper side of the base element and/or a base cover, a zipper and/or by means of straps.

The reclining furniture may comprise one or more reclining furniture covers. In particular, it may be provided that the reclining furniture comprises a first reclining furniture cover formed as a mattress cover and a second reclining furniture cover formed as an outer cover.

Optionally, another intermediate cover can be provided between the mattress cover and the outer cover. Alternatively or additionally, another outer cover can be pulled over the outer cover.

One or more of the covers, in particular the base cover, one or more reclining furniture covers, the mattress cover, the outer cover, another outer cover, and/or one or more intermediate covers, may be at least partially rubberized, coated, and/or provided with latex. In other words, one or more of the covers, in particular the base cover, the reclining furniture cover, the mattress cover, the outer cover, a further outer cover and/or one or more intermediate covers, may be formed to be waterproof, water-repellent and/or water-resistant.

Optionally, one or more of the covers, in particular the base cover, the recliner cover, the mattress cover, the outer cover, a further outer cover and/or one or more intermediate covers, may comprise an at least partially circumferential closure, in particular a zipper, which may optionally be at least partially waterproof to prevent or counteract penetration of water or moisture.

According to an embodiment, the reclining furniture cover comprises an at least partially circumferential closure, in particular a zipper, which is to be opened and/or closed for inserting and/or removing the mattress and/or the base element of the reclining furniture. Optionally, the zipper can be at least partially waterproof.

According to an embodiment, the at least one reclining furniture cover is formed as a mattress cover, wherein the mattress cover and/or a cover fabric of the mattress cover is formed at least partially from a spacer fabric, in particular a warp-knitted fabric and/or a weft-knitted fabric. Such spacer textiles can advantageously enable air and moisture exchange.

According to an embodiment, the mattress cover comprises a cover fabric having at least an upper layer and a lower layer, wherein the upper layer and the lower layer are at least partially arranged on top of each other, and wherein at least the upper layer of the cover fabric is formed from a weft-knitted fabric, for example a 3D weft-knitted fabric, and wherein a plurality of recesses are formed at least on an outer side of the upper layer facing away from the lower layer.

The lower layer may be knitted substantially closed and/or closed, and the recesses may form apertures or openings in the upper layer. The recesses may thus be bounded by the lower ply. Between the upper and lower layers, the recesses may optionally be at least partially bounded by spacer yarns. A contour of the recesses at the upper layer may be defined by knit stitches of the 3D weft-knitted fabrics at the upper layer.

The mattress cover thus takes advantage of a weft-knitted fabrics comprising, for example, a weft-knitted structure with stitches, for example at least partly of knitted mono- or multifilament weft-knitted fabrics.

Furthermore, the recesses formed on the outside allow for increased air circulation, increased breathability and/or increased moisture removal.

The weft-knitted spacer fabric used for mattress covers described herein differs in several respects from warp-knitted fabrics regularly used for covers. For example, warp-knitted spacer fabrics are regularly produced on so-called warp-knitting machines, while weft-knitted fabrics are generally produced on a knitting machine, with an additional distinction being made between flat and circular knitting machines. In the production of a warp-knitted fabric, stitches are strung around a warp (hence also warp-knitting machine). The stitches are thereby strung together vertically. Because of this stringing of stitches around a warp, the warp-knitted fabric is stable, rigid, inelastic and non-stretchable. In contrast, the stitches of a weft-knitted fabrics are not strung together around a warp, but the stitches as such can be elastic and stretchable, both in the horizontal and vertical directions. Compared to a warp-knitted fabric, a spacer fabric may therefore be characterized in particular by being elastic and stretchable in both the horizontal and vertical directions, whereas a warp-knitted fabric is, by comparison, completely inelastic and non-stretchable. Warp-knitted fabrics are therefore static and rigid fabric structures, which comprise little to no elasticity. Furthermore, a warp-knitted fabric has a rigid, hard and plastic-like feel, whereas a weft-knitted fabric may have a textile or fabric-like and soft feel. Furthermore, in warp-knitted fabrics, fiber ends regularly protrude from a surface of the fabric, resulting in a scratchy and rough feel. In contrast, weft-knitted fabrics generally have a much softer feel, which is sometimes due to the increased elastic properties of the weft-knitted fabric and a much finer finish compared to warp-knitted fabrics.

The mattress cover (comprising a mattress protective cover), can comprise a top side and/or a bottom side, each of which can be dimensioned as a lying surface for a user. The underside, however, only optionally provides a lying surface and does not necessarily have to be completely closed.

In the context of the present disclosure, the recesses formed at least on the outside of the top layer of the cover fabric are to be strictly distinguished from meshes from which the cover fabric, the bottom layer and/or the top layer may be formed. Compared to the meshes, the recesses may be larger in size, for example, the recesses may comprise a cross-sectional area that may be many times (such as 5 to 100 times or more) larger than an average cross-sectional area of the meshes of the cover fabric.

The cover fabric can generally be formed in two layers, three layers or multiple layers. In particular, the cover fabric can be made and/or formed entirely of weft-knitted fabrics and/or 3D weft-knitted spacer fabrics.

In a two-ply or two-layer design of the cover fabric, the upper and lower plies can be at least partially, for example selectively, connected and/or knitted together with threads of the upper and/or lower layer. Alternatively or additionally, connecting threads may be used which can connect the upper and lower layers. In the case of a three-layer or multilayer design of the cover fabric, one or more middle layers of the cover fabric may be connected and/or knitted to the upper and/or the layer. Alternatively or additionally, connecting threads can also be used here, which can connect at least two layers of the cover fabric, for example the upper layer, the lower layer and/or one or more middle layers.

The mattress cover can be produced in a simple manner, for example on a large-diameter circular knitting machine operating according to the so-called 3-way technique, with a high throughput in terms of time and thus with a high degree of economy.

The recesses can be configured to be open to the outside, i.e. in the direction of the user, and/or have a cross-section that is open to the outside. The recesses can thus designate openings. In this regard, the recesses can be generally advantageous in terms of air exchange and moisture removal, as well as compensation for temperature fluctuations. Also, the recesses may provide increased elasticity, which may provide a soft feel to a user and may also allow the cover to optimally conform to the user or head lying thereon without being affected by brittle spacer threads often felt in warp-knitted fabrics.

The recesses formed at least on the outside of the top layer may further provide and/or form a mesh structure of the cover fabric. In other words, the cover fabric may comprise a mesh structure, such as a honeycomb mesh structure, with the recesses, at least on the outer side.

For example, the recesses of the mesh structure and/or the cover fabric may be arranged in a regular pattern on the outer surface of the cover fabric. In other words, the recesses may be arranged regularly and/or in a regular pattern. However, an irregular arrangement, for example an arrangement forming a pattern, is also conceivable.

The recesses, such as the recesses open to the outside, can be variable in terms of their geometry, for example round, angular, oval, polygonal, elliptical or formed in any other way with regard to their open cross-section.

For example, the recesses may be formed in a honeycomb shape. Alternatively or additionally, the recesses may have a round, a rounded, an angular, a square, a rectangular, a polygonal, a triangular, an elliptical, an oval and/or a polygonal cross-section.

According to an embodiment, the top layer and/or the bottom layer of the cover fabric is formed at least partially from a natural fiber.

The use of natural fibers, which can be contained and/or knitted in the weft-knitted fabrics, for example, can increase the sustainability and/or ecology of the mattress cover (hereinafter also referred to as "cover"), for example because the natural fibers can be obtained from renewable raw materials. Natural fibers may also be characterized by increased resilience and/or durability. In addition, natural fibers may result in a pleasant, soft feel for the user. Also, natural fibers may be characterized by increased skin tolerance, breathability and/or odor neutrality. In addition, natural fibers can enable cost-efficient production of the mattress cover.

According to an embodiment, the natural fiber is an animal hair fiber, a wool fiber, cotton fiber, a hemp fiber, a eucalyptus fiber, a bamboo fiber, a linen fiber, a wood fiber, a viscose fiber, a flax fiber, a silk fiber, a plant fiber, or a combination thereof. Such natural fibers may be characterized, for example, by increased sustainability, odor neutrality, skin compatibility, durability, and/or robustness compared to synthetic fibers.

According to an embodiment, the upper layer, the lower layer and/or one or more middle layers of the upholstery fabric have a proportion by weight of natural fibers, relative to the respective layer or the entire upholstery fabric, of 2% to 99%, for example at least 5%, at least 10%, at least 15%, at least 20% and/or at least 25%. Also at least 30%, 35%, 40%, 45%, 50%, 55%, 60%, 65%, 70%, or 75% of natural fibers is conceivable.

According to an embodiment, the proportion, such as the weight proportion and/or the volume proportion, of natural fibers, such as related to the respective layer or the entire cover fabric, in the upper layer is greater than the proportion, such as the weight proportion and/or the volume proportion, of natural fibers in the lower layer and/or one or more middle layers. For example, the proportion in the upper layer may be at least twice as large as the corresponding proportion of natural fibers in the lower and/or one or more middle layers.

According to an embodiment, the top layer consists essentially and/or almost entirely, for example entirely, of natural fibers and the bottom layer, and optionally one or more middle layers, consist essentially and/or almost entirely, for example entirely, of synthetic fibers.

According to an embodiment, the upper layer and/or the lower layer of the cover fabric is formed at least partially from textured, twisted yarn, in particular multifilament yarn, for example polyester yarn, polyethylene yarn, polyamide yarn, polyethylene yarn and/or polyamide yarn. This can provide a soft and pleasant feel.

According to an embodiment, the upper layer and/or the lower layer of the cover fabric is formed at least partially from monofilament yarn, in particular polyester yarn, smooth polyester yarn, polyethylene yarn, smooth polyethylene yarn, polyamide yarn, and/or smooth polyamide yarn. When the cover fabric is formed from monofilament yarn on the underside of the cover fabric facing the mattress core or the pillow core, removal or insertion of the mattress core or pillow core can be facilitated.

For example, the cover fabric can be formed from weft-knitted fabrics in at least two layers, with an upper layer forming the outer side and a fabric layer forming an inner or lower layer, preferably of polyester fiber fabric, polyethylene fiber fabric and/or polyamide fiber fabric.

The inner or lower layer can, for example, be a smooth fabric layer, which can also be jacquardized and/or provided with a pattern, for example, on which the upper layer of the weft-knitted fabrics made of textured, twisted yarn, in particular multifilament yarn, can be built up towards the outside.

According to an embodiment, the cover fabric further comprises a middle layer which is at least selectively and/or at least partially knitted with the top layer and/or the bottom layer. The middle layer can serve to volumize the cover fabric. In this way, lying comfort can also be increased.

According to an embodiment, the middle layer is at least partially formed from a monofilament yarn, in particular polyester yarn, smooth polyester yarn, polyethylene yarn, smooth polyethylene yarn, polyamide yarn, and/or smooth polyamide yarn.

According to an embodiment, the middle layer is formed at least in part from a multifilament yarn, for example, a textured twisted multifilament yarn, for example, polyester yarn, polyethylene yarn, polyamide yarn, polyethylene yarn, and/or polyamide yarn.

According to an embodiment, the middle layer is at least partially formed from a natural fiber. This offers the advantages explained above with regard to natural fibers.

According to an embodiment, the recesses extend at least substantially through a thickness of the top layer and optionally the middle layer. In particular, the recesses can extend completely through the upper layer, so that the recesses can form and/or represent apertures in the upper layer, as it were.

For example, the recesses may extend at least substantially across the entire thickness of the top layer, that is, from the outside to or close to the inner or bottom layer, such as to allow optimal climate control with respect to air and moisture exchange between the two sides of the cover fabric. In addition, the depth of the recess can increase the softness of the upper layer of weft-knitted fabrics, thus obtaining an improved feel.

The cover fabric can further be formed in three layers with a middle layer, such as a layer knitted with the upper layer, with a monofilament yarn as filler. In this case, stabilization and a haptically frequently desired volumization of the weft-knitted fabrics can be achieved with simultaneous high air and moisture permeability. The monofilament yarn can, for example, be formed at least partially from polyester, polyamide and/or polyethylene, but other synthetic fibers can also be used for this purpose.

To give the outward-facing surface or outer side of the weft-knitted fabrics a particularly smooth and pleasant feel, the surface or outer side surrounding the recesses can be formed from finer knit stitches compared to other areas of the outer side.

According to an embodiment, the top layer has a weight proportion of 50% to 70%, in particular 55% to 60%, of the cover fabric. Investigations have shown that this proportion by weight is particularly advantageous in terms of comfort and microclimatization.

According to an embodiment, the bottom layer has a weight percentage of 20% to 30%, in particular 25% to 30%, of the cover fabric.

According to an embodiment, a middle layer has a weight percentage of 10% to 20%, in particular 15% to 20%, of the cover fabric.

When using a filler, optimum results in terms of air permeability, stabilization and volumization were determined at a weight content of 10% to 20%, in particular 15% to 20%, of the middle layer on the cover fabric.

According to an embodiment, the cover fabric has a weight of 250 $g/m^2$-300 $g/m^2$. This enables the upholstery fabric to comprise the required durability and at the same time to be easy to handle in terms of its weight during manufacture as well as during use.

According to an embodiment, the cover fabric is rubberized, coated and/or provided with latex on at least one side, for example the outer side, the inner side, the bottom side and/or the top side, for example to prevent moisture and/or water from penetrating.

According to an embodiment, the cover fabric is formed identically on all sides. In other words, the mattress cover can be formed identically on all sides, i.e. on the top side, on the bottom side and on the longitudinal and transverse sides, if present, although it is also conceivable in principle to form different sides of the cover differently.

The identical design of all sides can enable particularly simple production, whereby the high breathability of the cover fabric also means that a ventilation strip on the transverse and longitudinal sides, which is frequently found in known covers, in particular mattress covers, can be dispensed with.

According to an embodiment, the mattress cover comprises an at least partially circumferential closure, in particular a zipper, to be opened or closed for inserting or removing a mattress core and/or a pillow core. In order to enable insertion and removal of a mattress core or a pillow core, it may be advantageous if the mattress cover comprises an at least partially circumferential closure, in particular a zipper.

Furthermore, handles may be sewn to the mattress cover for easier handling of a mattress covered with the mattress cover and/or the reclining furniture.

The mattress cover may further be washable, for example, at a temperature of at least 30° C., at least 40° C., at least 50° C., at least 60° C., at least 70° C., at least 80° C., or at least 90° C.

Another aspect of the present disclosure relates to the use of a mattress cover for a reclining furniture as described above and below.

The reclining furniture with mattress cover can be advantageous especially for indoor use of the reclining furniture. Instead of or additionally, the reclining furniture can also comprise an outer cover. The outer cover can enclose the base element, the mattress, and optionally the mattress cover at least partially, in particular completely.

Optionally, a further outer cover can be provided, which can at least partially, in particular completely, enclose the outer cover. The further outer cover can, for example, be formed analogously to the mattress cover as described above and below. By providing the further outer cover, a lying comfort for the user can be increased and a protection against water can be ensured by the underlying outer cover and/or a further cover, in particular the basic furniture cover.

According to an embodiment, the at least one reclining furniture cover is formed as an outdoor cover, in particular for use of the reclining furniture outdoors, wherein the outdoor cover is at least partially waterproof, washable and/or thermally insulating.

According to an embodiment, the outer cover comprises silicone, rubber, polymer-based material, fiber material, fabric, latex, plastic, leather, synthetic leather, and/or plastic.

Different materials, colors, haptics are conceivable and/or combinable for the outer cover.

According to an embodiment, the outer cover comprises an at least partially circumferential closure, in particular a zipper, to be opened and/or closed for inserting and/or removing the mattress and/or the base element of the reclining furniture, wherein the closure is configured to be at least partially waterproof. This can be particularly advantageous for use of the reclining furniture outdoors or in harsh environments.

According to an embodiment, the reclining furniture further comprises an anti-slip layer or ply deposited on the top layer of the base element and arranged between the base element and the mattress, wherein the anti-slip layer or ply is configured to prevent the mattress from sliding on the base element. The anti-slip layer or sheet may comprise, for example, rubber, silicone, latex or the like.

According to an embodiment, the mattress comprises at least one head support region for supporting a head, at least one neck support region for supporting a neck, at least one shoulder support region for supporting shoulders, at least one lordosis support region for supporting at least a portion of a spine, and at least one pelvis support region for supporting a pelvis of the user.

According to an embodiment, the head support area, the neck support area, the shoulder support area, the lordosis support area and the pelvis support area have profiles that are at least partially different from one another on the first and/or on the second side of the mattress. Such profiles can, for example, be profiling and/or structuring, so that a hardness, compression hardness and/or a degree of hardness of at least part of the individual support regions, i.e. head support region, neck support region, shoulder support region, lordosis support region and/or pelvic support region, differ from one another and/or so that the compression hardnesses of the mattress (or of mattress elements of the mattress) differ from one another at least in regions. The mattress can further optionally be a mattress and/or reversible mattress, which can provide different degrees of hardness.

For ergonomic and comfortable lying, the mattress (or mattress elements thereof respectively) may be divided into different support areas and/or zones. In particular, the mattress may comprise one or more head support zones, one or more neck support zones, one or more shoulder support zones, one or more lordosis support zones, and one or more pelvic support zones. The different support areas can comprise different compression hardnesses, degrees of hardness and/or elasticities, so that the user sinks into or is supported by the outer surface to different depths in the respective support area. Also, a weight distribution of the user over at least a part of the first and/or second outer surface can be taken into account by the different support areas. For example, the different compression hardnesses of the support areas can take into account the fact that the user's head has a lower weight compared to the pelvis. The different compression hardnesses in the different support areas can further ensure that the spine or back of the user is straight, such as when the user is lying on his side, or comprises the typical S-shape, such as when the user is lying on his back.

The different compression hardnesses in the respective support areas can be realized by using different materials, such as differently hard or soft mattress foam and/or polyurethane foam, by different profiles and/or by different structuring of the first and/or second outer surface. Such profiles may comprise, for example, grooves, corrugations, notches, cutouts, transverse grooves, recesses, channels, indentations and/or recesses.

According to an embodiment, the mattress (or mattress elements thereof) comprises, relative to a transverse center axis and/or a transverse center plane, a first half and a second half which are arranged one behind the other along a longitudinal axis of the mattress. In each half, the mattress (or one or more mattress elements) comprises a head support region, a neck support region, a shoulder support region, a lordosis support region, and a pelvic support region. The two head support regions, neck support regions, shoulder support regions, lordosis support regions and pelvis support regions of the mattress (or one or more mattress elements), can thus be arranged in mirror symmetry relative to the central transverse axis and/or central transverse plane.

According to an embodiment, the first half and the second half of the mattress (or one or more mattress elements) are formed symmetrically, in particular mirror-symmetrically, relative to the center transverse axis and/or center transverse plane of the mattress or the reclining furniture. In particular, with regard to a formation of the various support areas as well as a structuring and/or profiling of the various support areas, the mattress (or individual mattress elements) can be formed mirror-symmetrically.

For example, the support regions may be formed in each of the first and second halves of the mattress (or one or more mattress elements) as described below. One head support region extends from each end of the mattress in the direction of the central transverse axis. One neck support region joins each of the head support regions and extends further in the direction of the central transverse axis of the. One shoulder support area shoots up to each of the neck support areas and extends further in the direction of the center transverse axis. One lordosis support area joins each of the shoulder support areas and extends in the direction of the center transverse axis. One pelvic support area joins each lordosis support area and extends to the center transverse axis.

According to an embodiment, the first and/or the second side of the mattress comprises at least one recess and/or at least one transverse groove at least in a partial area. One or more transverse grooves can be formed in the individual support areas. Transverse grooves of different areas can differ, for example, in terms of number, geometry, cross section, size, depth or the like.

The transverse grooves can extend essentially parallel to the transverse axis of the reclining furniture over the entire width of the first and/or second side of the mattress. Individual transverse grooves can be perceptible as macroscopic depressions, incisions or recesses.

According to an embodiment, the mattress comprises at least two mattress elements which are at least partially stacked on top of each other. Alternatively or additionally, the mattress comprises at least a first mattress element and a second mattress element which are at least partially stacked on top of each other. The mattress may also comprise more than two mattress elements. A thickness of the mattress elements, which is dimensioned orthogonally to the longitudinal axis and to the transverse axis, can be identical to or different from one another.

According to one embodiment, each of the two mattress elements comprises an outer surface and a contact surface, wherein the contact surface of the first mattress element is at least partially in contact with the contact surface of the second mattress element, and wherein at least one of the outer surfaces and/or contact surfaces of at least one of the first and second mattress elements comprises a profile, in particular a profile with one or more transverse grooves. For example, a profile may be provided on one or both of the outer surfaces. Optionally, a profile with one or more transverse grooves may additionally or exclusively be formed on one or both of the contact surfaces.

In particular, profiles can be provided on one of the outer surface and the contact surface of each mattress element, which can have profiles that differ from one another. If a profile is provided on both contact surfaces, the profiles of the two mattress elements can optionally at least partially interlock and/or be formed to correspond to each other.

According to an embodiment, the outer surface and/or the contact surface of the first mattress element comprises a first profile, and the outer surface and/or the contact surface of the second mattress element comprises a second profile, wherein the first profile differs at least partially from the second profile such that a degree of hardness of the first mattress element differs from a degree of hardness of the second mattress element. For example, the profiles may comprise different transverse grooves.

The degree of hardness or compression hardness for the first and second mattress elements can further be influenced, for example, by the choice of material for the respective mattress element, e.g. different types of foam (such as polyurethane foam) can be selected. Furthermore, the degree of hardness can be influenced by corresponding structures, such as grooves, transverse grooves, beads, grooves, incisions, cutouts, recesses, channels, indentations and/or recesses, which can be formed, for example, in the first and/or second outer surface and/or the first and/or second contact surface. Furthermore, the connection of the first mattress element to the second mattress element can also be influenced, in particular by the choice and/or design of a profile. on at least one of the contact surfaces. Alternatively or additionally, the degree of hardness in the different areas of the mattress element may be different, for example by the choice of material, the profiling and/or the structuring of the respective outer surface and/or the design of the contact surface(s). For example, a shoulder support area may be designed to be slightly softer than a neck support area so that the user's shoulder sinks deeper into the outer surface of the mattress than the user's neck, particularly when the user is lying sideways on the respective outer surface of the mattress element.

According to an embodiment, at least one of the first contact surface and the second contact surface has a profile with one or more transverse grooves at least in a partial area. This allows support properties to be further improved or influenced.

According to an embodiment, the profile is formed exclusively on the second contact surface of the second mattress element. Alternatively or additionally, no profile is formed on the first contact surface of the first mattress element.

According to an embodiment, the first contact surface and the second contact surface comprise mutually corresponding and/or at least partially interlocking profiles. For example, the profiles can interlock in a tooth-like manner to mutually fix the mattress elements.

According to an embodiment, a degree of firmness of the first mattress element is greater than a degree of firmness of the second mattress element. The reverse may also be the case.

According to an embodiment, at least one, in particular several, transverse groove extending in the transverse direction of the mattress is formed on the first outer surface of the first mattress element and/or on the second outer surface of the second mattress element between the at least one head support region and the at least one neck support region, which transverse groove has a T-shaped, trapezoidal and/or triangular cross section. The transverse groove can be formed, for example, as a groove, bead, groove, cutout, recess, channel, notch and/or recess, over the entire width in the transverse direction of the mattress (also referred to as a combination mattress).

Generally, at least one transverse groove may be formed in at least one of the head support area, the neck support area, the shoulder support area, the lordosis support area, and the pelvis support area. In general, the profiles in the individual support areas can be given and/or defined by the transverse grooves or the absence of transverse grooves. Transverse grooves of different support areas may differ from each other with respect to their geometry, their cross-section, a depth of the respective transverse grooves, a dimension, a length and/or a width. As a result, the degree of hardness of the individual support areas can be varied and/or matched to one another. One or more transverse grooves may thereby comprise a drop-shaped, a circular, a triangular, a trapezoidal, a round, an oval, an elliptical or a T-shaped cross-section. In general, a depth of the transverse grooves dimensioned along the vertical axis may be about 1 to 5 cm, and a width of the transverse grooves dimensioned along the longitudinal axis may be about 1 to 4 cm.

Optionally, one or more transverse grooves can also be made in the material of the mattress in such a way that they are at least partially covered on the outside by material of the mattress.

According to an embodiment, at least one, in particular several, transverse groove extending in the transverse direction of the mattress is formed on the first outer surface of the first mattress element and/or on the second outer surface of the second mattress element in the at least one pelvic support region, which transverse groove has a T-shaped, trapezoidal, and/or triangular cross section.

According to an embodiment, at least one, in particular several, transverse groove extending in the transverse direction of the mattress is formed on the first outer surface of the first mattress element and/or on the second outer surface of the second mattress element in the at least one shoulder support region, which transverse groove has a round, oval, teardrop-shaped and/or elliptical cross-section.

According to an embodiment, a plurality of transverse grooves extending in the transverse direction of the mattress are formed on the first outer surface of the first mattress element in the at least one shoulder support region, which transverse grooves each have a round and/or teardrop-shaped cross-section, wherein the transverse grooves formed in the shoulder support region have identical diameters, cross-sections and/or sizes. The size of a transverse groove can designate a dimension, such as a width, of the respective transverse groove measured in the longitudinal direction of the mattress.

According to an embodiment, a plurality of transverse grooves extending in the transverse direction of the mattress are formed on the second outer surface of the second mattress element in the at least one shoulder support region, which transverse grooves each have a round and/or teardrop-shaped cross-section, at least some of the transverse grooves formed in the shoulder support region having different diameters and/or sizes. The diameters, dimensions, widths and/or sizes of the transverse grooves can thereby decrease in the direction of the central transverse axis and/or the central plane.

Another aspect of the present disclosure relates to the use of a reclining furniture as described above and below for reclining and/or sitting in an outdoor area, outdoors and/or in a harsh environment.

Another aspect of the present disclosure relates to the use of a base element, as described above and below, for deforming and/or adjusting a mattress placed on the base element. In other words, the base element can be used in combination with any mattress which is placeable on the base element, in particular on the top layer thereof.

Further features, advantages and possible applications of the disclosure will be apparent from the following description of the exemplary embodiments and figures.

BRIEF DESCRIPTION OF DRAWINGS

The figures are merely schematic and not to scale. If the same reference signs are given in different figures in the following description, these designate identical, identically acting, similar or similarly acting elements.

DETAILED DESCRIPTION OF EXEMPLARY EMBODIMENTS

Figure 1A:
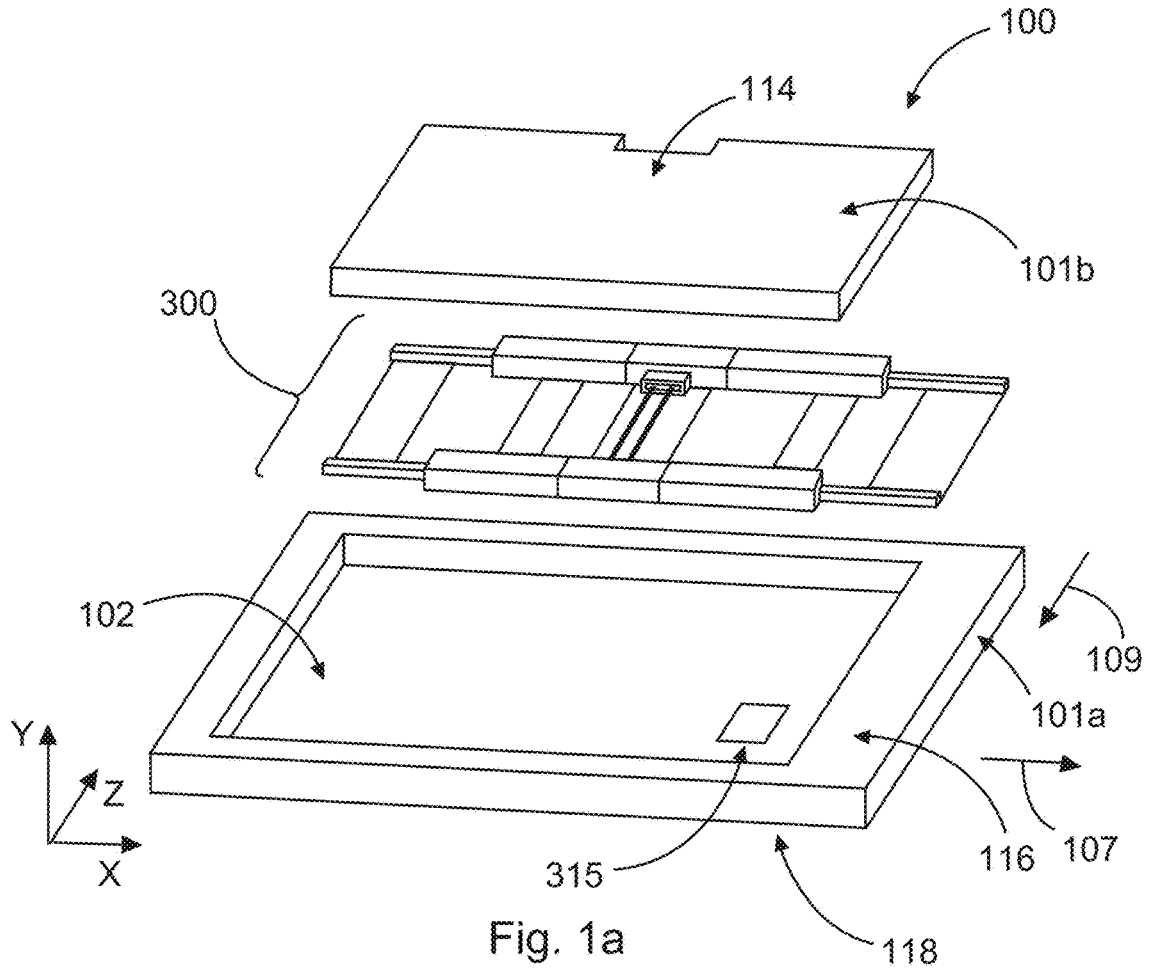
FIG. 1*a* shows a base element according to an exemplary embodiment.
Figure 1B:
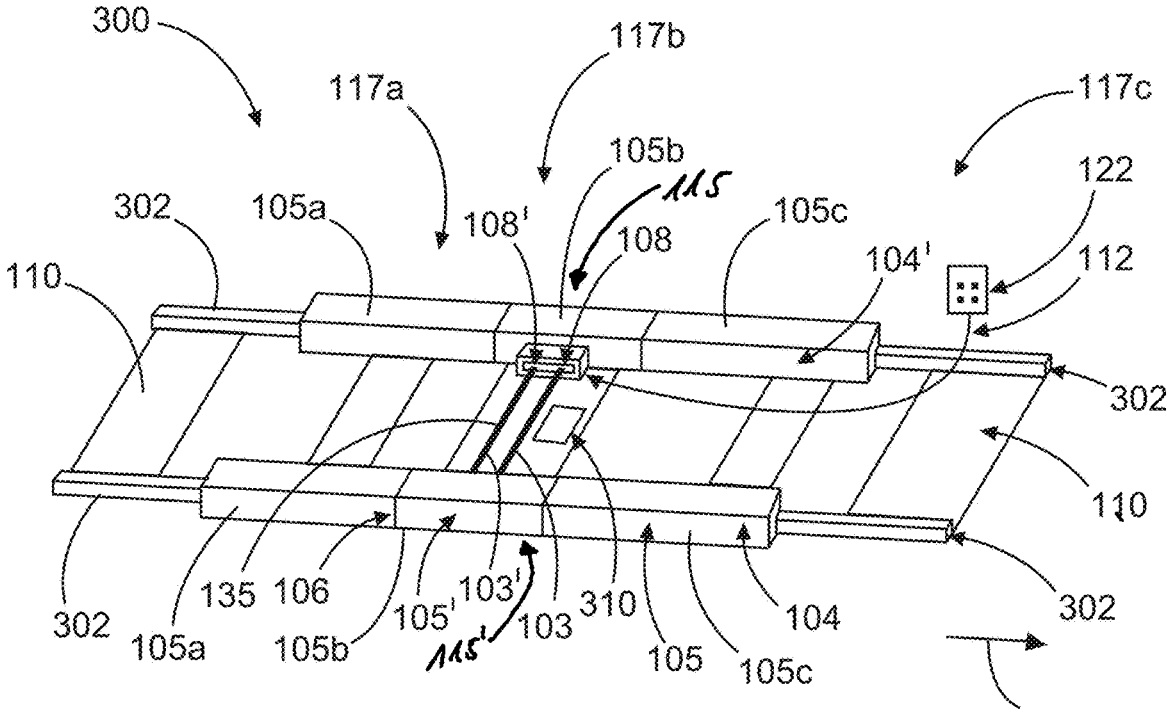
FIG. 1*b* shows an adjustment device of a base element according to an exemplary embodiment.
Figure 2:
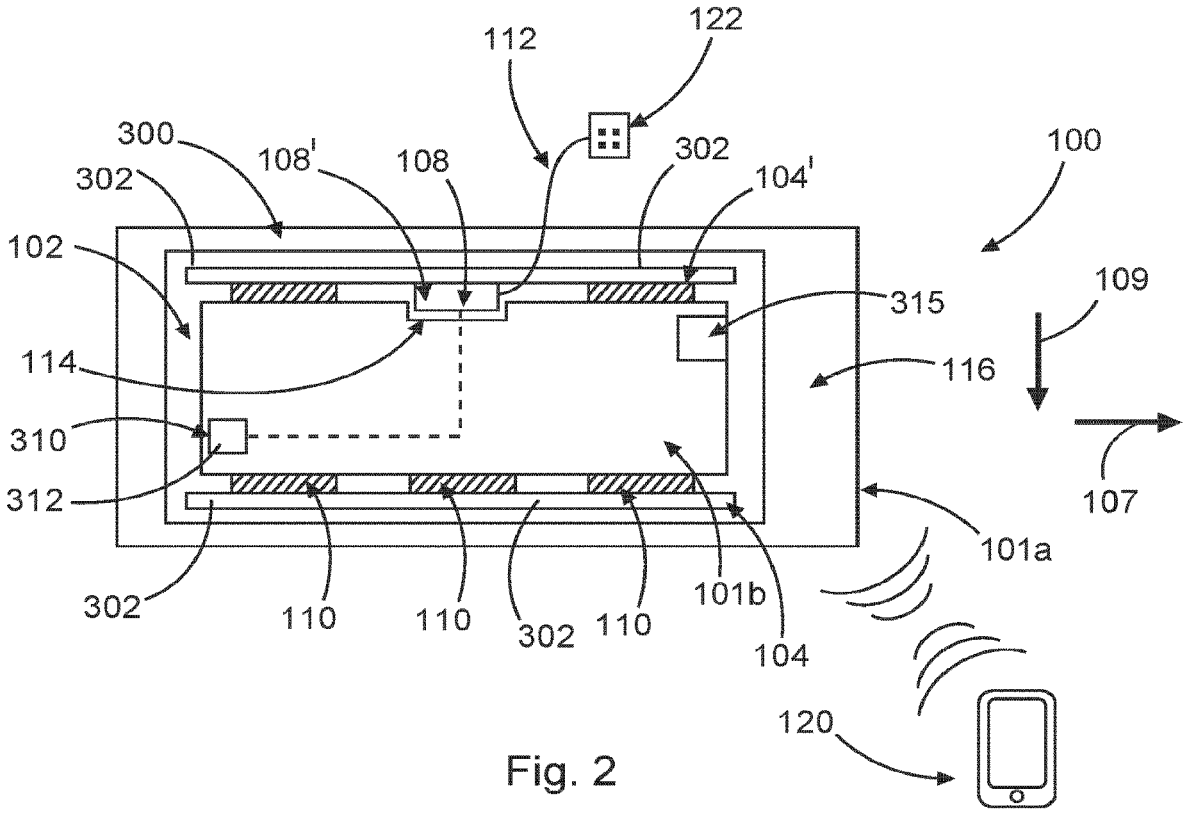
FIG. 2 shows a top view of a base element according to an exemplary embodiment.

FIG. 1*a* shows an exploded view of a base element 100 according to an exemplary embodiment. FIG. 1*b* shows an adjustment device 300 of the base element of FIG. 1*a*. FIG. 2 shows a top view of the base element 100 of FIG. 1*a*.

The base element 100 comprises a frame element 101*a* and a cover layer 101*b*. The base element 100 further comprises an adjustment device 300. The frame element 101*a* has a compartment 102, wherein the compartment 102 is formed and/or dimensioned such that the adjustment device 300 can be accommodated and/or integrated in the compartment 102. Thus, the adjustment device 300 is at least partially received in the compartment 102.

The cover layer 101*b* of the base element is arranged on the frame element 101*a*. The frame element 101*a* may be formed partially or entirely of foam. Similarly, the cover layer 101*b* may be formed partially or entirely of foam. However, other materials are conceivable.

The cover layer 101*b* may optionally include a cutout 114, which may be formed to provide space for mounting/dismounting one or more components of the adjustment device 300.

The adjustment device 300, which is configured for deforming or adjusting the base element 100 and/or a mattress 202 placed thereon, comprises one or more drives 108, 108', for example two electric motors, and at least two rails 104, 104', which are arranged substantially parallel to each other and are connected to each other via at least one cross strut 103. Each of the rails 104, 104' thereby extends substantially parallel to a longitudinal axis 107 of the base element 100 and the at least one cross strut 103 extends substantially parallel to a transverse axis 109 of the base element 100.

Each of the rails 104, 104' comprises, by way of example, three rail elements 105*a*, 106*b*, 105*c*, which are arranged one behind the other in the longitudinal direction of each rail 104, 104' and/or parallel to the longitudinal direction 107. The rail elements 105*a*, 105*b* and 105*b* and 105*c* are each movably coupled to one another at their ends via a joint 106, so that the rail elements 105*a*, 105*b* and 105*b* and 105*c* can be pivoted about an axis parallel to the transverse axis 109 via the joints 106.

In the example of FIGS. 1*a*, 1*b*, and 2, the base element 100 or adjustment device comprises two drives 108, 108' and two drive mechanisms 115, 115'. Each drive mechanism may comprise one or more pulley mechanisms and/or gear mechanisms, which may be at least partially arranged and/or integrated in one or more rail elements 105*a*-105*c*. Further, the adjustment device comprises two crossbars 103, 103', each of which may be associated with a drive mechanism 115, 115'.

A shaft 135 may be arranged in each of the cross struts 103, 103' and coupled to one of the drives 108, 108'. Alternatively, the cross struts 103, 103' can each form a shaft 135.

The drives 108, 108' are thereby arranged on one of the two rails 104' and can actuate the drive mechanism located in the rail elements of this rail, for example a cable pull mechanism and/or a gear mechanism. The rotation of the respective drive 108, 108' can be transmitted to and actuate the oppositely arranged rail 104 and the drive mechanism located in the rail elements of this rail, such as a cable pull mechanism and/or a gear mechanism, via the associated shaft 135 or cross strut 103, 103'. In this way, portions 117*a*, 117*b*, 117*c* arranged between the rail elements 105*a*-105*c* opposing each other in pairs in the transverse direction 109 can be displaced, pivoted and/or tilted relative to each other.

To extend the rails 104, 104' in the longitudinal direction 107, a longitudinal support strut 302 is arranged at each end of each rail element 105*a*, 105*c*, such as at each head end and/or foot end of each rail 104, 104', of the base element 100, which are spaced apart and coupled to each other via one or more transverse support struts 110 in the transverse direction 109. On the one hand, the areas 117*a* and 117*c* can thus be enlarged, a stability of the adjustment device 300 can be increased and the adjustment device 300 can withstand increased loads. In addition to the areas 117*a*-117*c*, areas extending beyond the front ends, head ends, and/or foot ends of the adjustment device 300 can also be individually displaced. Thus, in the example of FIGS. 1*a*, 1*b*, and 2, at least three, four, or five differently and individually adjustable regions may be created. More or fewer areas may also be provided.

The adjustment device 300 further comprises a control circuitry 310 configured to control the adjustment device 300 and/or one or more drives 108, 108'. For example, the control circuitry 310 can be used to control a direction of rotation, a speed of rotation, or the like. This can be done via a suitable control signal.

The control circuitry 310 further comprises an interface 112 coupled to a user interface 122 via a wired connection. The control unit 122 may comprise a user interface, such as a display, buttons, or the like, for controlling the control circuitry and/or the adjustment device 300. Alternatively or additionally, the control circuitry 300 has a wireless interface 312 for communicating with a receiver 120, such as a smartphone, tablet, PC, notebook, server, or the like, as shown in FIG. 2.

Further, the base element 100 includes an energy storage device 315, such as a battery or accumulator, for supplying electrical energy to the adjustment device 300. The energy storage device 315 can be charged, for example, via a cable that can optionally be routed through the frame element 101*a* and/or the cover layer 101*b*. Inductive charging or other techniques are also conceivable.

Further, components of the adjustment device 300 may be configured to be at least partially waterproof.

Figure 3:
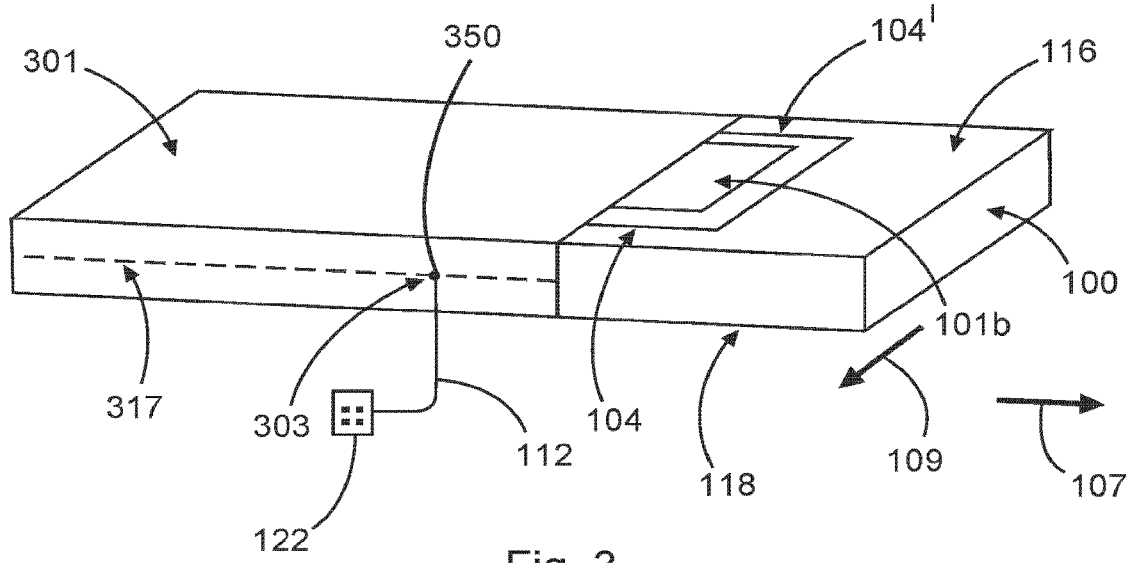
FIG. 3 shows a base element according to an exemplary embodiment.

FIG. 3 shows a base element 100 according to an exemplary embodiment. Unless otherwise described, the base element 100 of FIG. 3 comprises the same elements and features as the base element 100 of FIGS. 1*a* to 2.

The base element 100 of FIG. 3 further has a base cover 301 in which the frame element 101*a*, the cover layer 101*b* and/or the adjustment device 300 are at least partially, in particular completely, accommodated. The base cover 301 is configured in particular to prevent a mattress 202 placed on the base element 100 from slipping. In this regard, the base cover 301 may be made of any material and/or fabric, in particular natural fiber, synthetic fiber or a mixture thereof. Also, the base cover 301 may serve to protect the base element 100.

Optionally, the base cover may also be at least partially waterproof, for example on its bottom, sides, and/or top. In particular, the base cover 301 may be at least partially rubberized, coated, and/or provided with latex, for example, on its outer side, inner side, top side, and/or bottom side.

The base cover 301 may be at least partially formed from a rubber-like material. Alternatively or supplementally, the base cover 301 is at least partially rubberized. Alternatively or complementarily, the base cover 301 is at least partially formed of latex. In particular, an upper surface on which a mattress 202 may be placed and/or an outer surface of the base cover 301 may be at least partially rubberized, coated, and/or provided with latex to prevent slippage of a mattress 202.

The base cover 301 comprises an at least partially circumferential closure 303, in particular a zipper 303, to be opened and/or closed for inserting and/or removing the base element 100. Optionally, the (zipper) closure 303 may be at least partially waterproof.

The base cover 301 may further comprise one or more cable grommets 350, such as for passing a cable of the control circuitry 112 and/or the user interface 120. Optionally, the cable feedthrough 350 may be mechanically reinforced, such as with an eyelet. Further optionally, the cable feedthrough 350 may be configured to be sealed, may at least partially enclose the cable in a sealed manner, and/or may comprise a sealing element.

Figure 4:
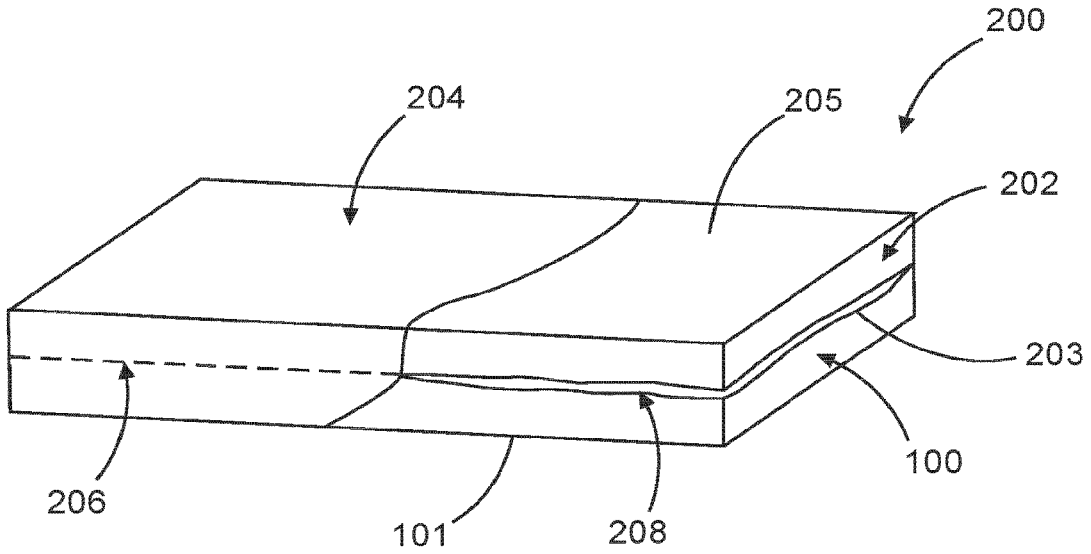
FIG. 4 shows a reclining furniture according to an exemplary embodiment.
Figure 5:
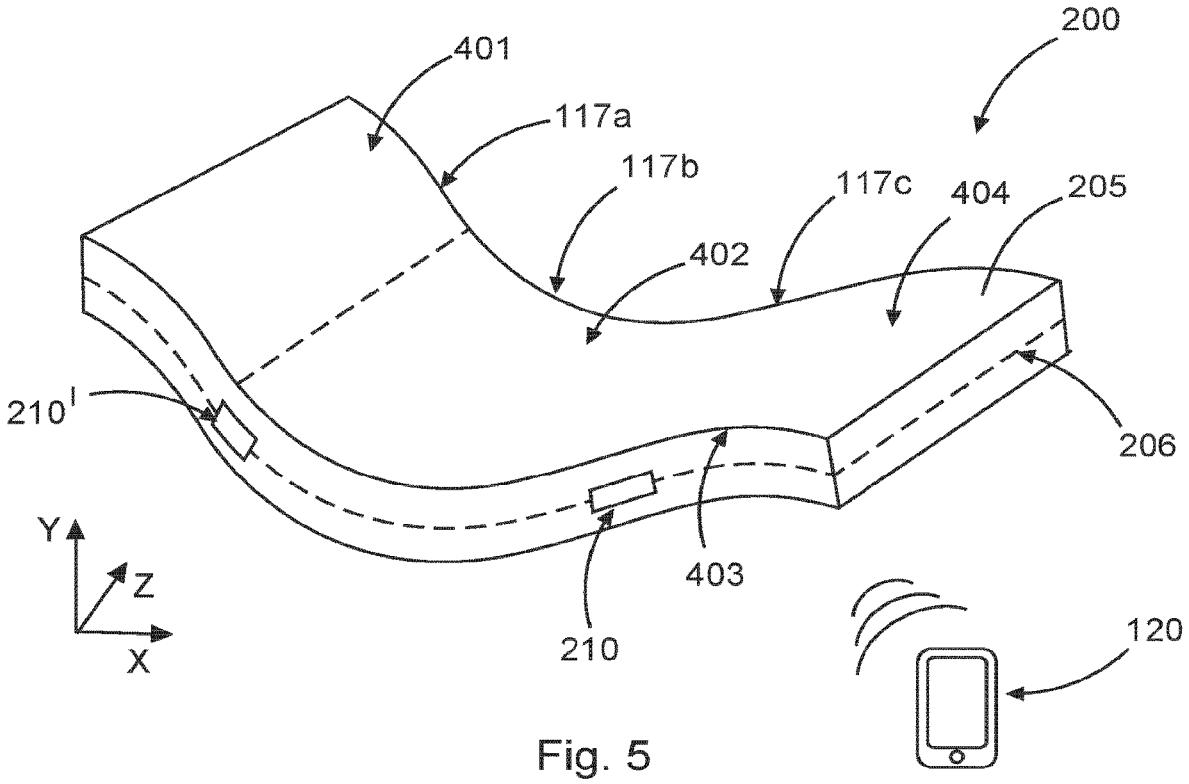
FIG. 5 shows a reclining furniture according to an exemplary embodiment.

FIGS. 4 and 5 each show a reclining furniture 200 according to an exemplary embodiment.

The reclining furniture 200 comprises a base element 100 on which a mattress 202 having a first side 203 is arranged and/or laid. Opposite the first side 203, the mattress 202 forms a lying surface 205 for a user. The lying surface thereby faces a bottom surface 101 of the base element 100. The base element 100 of FIGS. 4 and 5 may be formed like the base element 100 of the figures described above.

The reclining furniture 200 further comprises at least one reclining furniture cover 204, which encloses the base element 100 and the mattress 202 at least partially, in particular completely. The reclining furniture cover 204 may thereby be formed as a mattress cover 204 as described with respect to FIGS. 6 to 8. Optionally, the reclining furniture cover 204 and/or mattress cover 294 may be at least partially coated, rubberized and/or provided with latex to prevent water from penetrating.

Alternatively or in addition to the mattress cover 204, a further reclining furniture cover 204 may also be provided in the form of an at least partially waterproof outer cover 204 which may at least partially, in particular completely, enclose the base element, the mattress and optionally the mattress cover.

Optionally, a further outer cover may also be provided which at least partially, in particular completely, encloses the outer cover 204. The further outer cover can be configured analogously to the mattress cover as described above and below. Optionally, the further outer cover can also be at least partially coated, rubberized and/or provided with latex in order to prevent the penetration of water.

One or more of the reclining furniture covers 204 may comprise an at least partially, in particular fully circumferential closure 206, such as a zipper, which may optionally be at least partially waterproof.

For transport, two or more transport handles 210, 210' may also be provided on each flank of the reclining furniture 200. These may be at least 2 to 10 cm wide or wider and/or at least 5 to 20 cm long or longer, for example to ensure high stability and high carrying comfort.

In FIG. 4, the reclining furniture 200 is shown in a horizontal position. In FIG. 5, on the other hand, the individual areas 117*a*-117*c* are adjusted and/or displaced by the adjustment device 300, so that a total of at least four lying areas 401, 402, 403, 404 on the reclining furniture 200 or the lying surface 205 are arranged and/or positioned differently relative to one another. The user can individually change, adjust and/or adapt the individual areas or reclining areas via one of the operating devices 120, 122.

Figure 6:
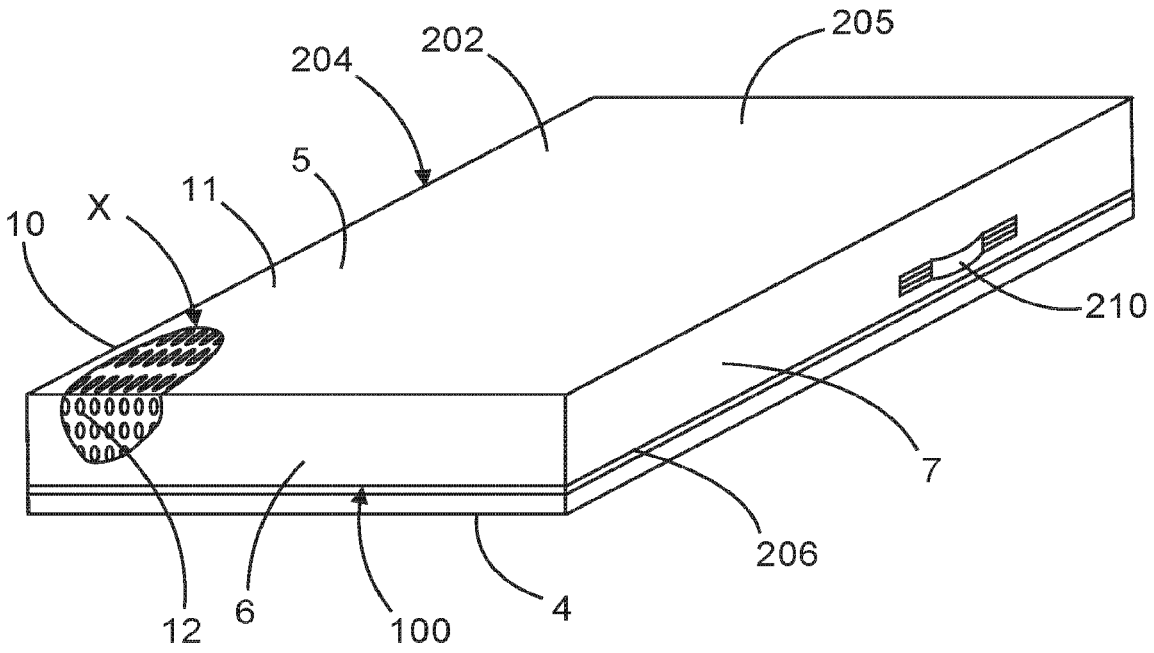
FIG. 6 a perspective view of a mattress cover of a reclining furniture according to an exemplary embodiment.
Figure 7:
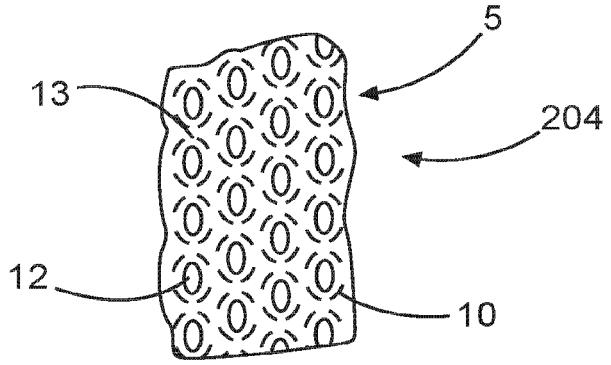
FIG. 7 shows a highly simplified sectional top view of an outer side of the mattress cover of FIG. 6.
Figure 8:
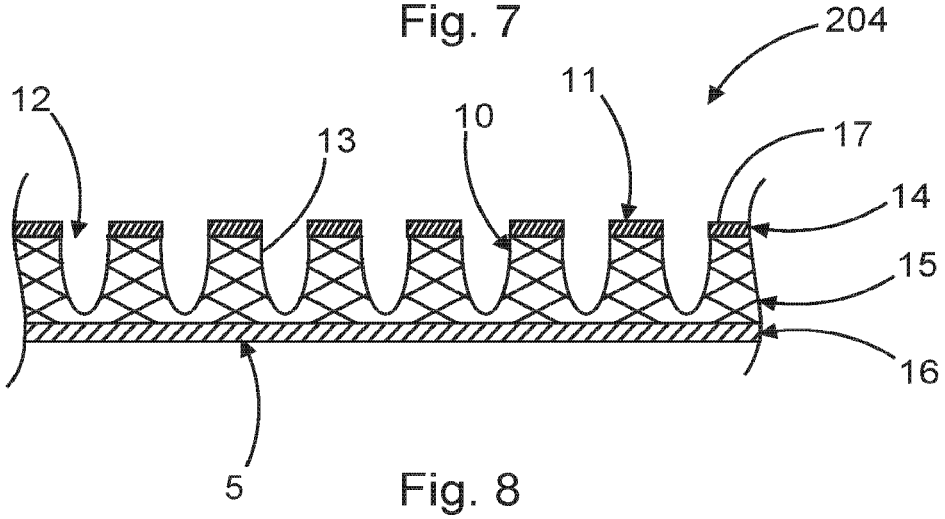
FIG. 8 shows a sectional schematic cross-sectional view through a cover fabric of the mattress cover of FIGS. 6 and 7.

FIG. 6 shows a perspective view of a mattress cover 204 of a reclining furniture 200 according to an exemplary embodiment. FIG. 7 shows a highly simplified sectional top view of an outer side of the mattress cover 204 of FIG. 6. FIG. 8 shows a sectional schematic cross-sectional view through a cover fabric of the mattress cover 204 of FIGS. 6 and 7.

Referring to FIG. 6, an exemplary mattress cover 204 or mattress cover 204 is shown in a state stretched over a mattress 202 and a base element 100, wherein the cover 204 forms a first reclining surface on an upper surface 205 and optionally forms a second reclining surface for a user on an opposite lower surface 101.

The mattress cover 204 is formed circumferentially from the same cover fabric 5, whereby lateral transverse surfaces 6 and longitudinal surfaces 7 also merge, optionally seamlessly, into the upper side 6 and lower side 7. Deviating from this, however, in other embodiments, a separation of the surfaces of the cover fabric 5 can also be provided by seams and, optionally, a welting tape.

A circumferential closure 206 in the form of a zipper is sewn into the mattress cover 204 (or mattress cover 204) at the transverse surfaces 6 and longitudinal sides 7 for inserting and removing the mattress cover 202 and/or the base element 100. In addition, a plurality of handles 210 are provided on the lateral longitudinal surfaces 7 for lifting the base element 100 and/or the mattress 2020 encircled by the mattress cover 202 (or mattress cover 2), of which only one handle 210 is shown by way of example.

As can be seen in a section X in FIG. 6, which is representative of the entire surface of the mattress cover 204 (or mattress cover 204), and in FIGS. 7 and 8, the cover fabric 5 is formed with a weft-knitted fabric 10, such as a 3D weft-knitted fabric, to its outer surface 11.

The cover fabric 5 comprises a honeycomb-like mesh structure with outwardly open recesses 12 in a regular, fine arrangement. In this respect, the recesses 12 preferably have a round, rounded, elliptical and/or oval cross-section towards the outside, which in the untensioned state may be dimensioned, for example, 2 mm to 4 mm in width and about 3 mm to 5 mm in length.

The material webs 13 of weft-knitted fabrics 10 located between the recesses 12, which are arranged offset and regular to each other, can be at least approximately equal in width.

The cover fabric 5 of the cover 1 is present as a two- or three-ply (or layer) weft-knitted fabrics with an upper ply 14 forming the outer side 11, an optional middle ply 15 forming the weft-knitted fabric 10 and knitted with the upper ply 14, and an inner or lower ply 16 knitted with the upper ply 14 and/or the optional middle ply 15.

The upper layer 14 may comprise a monofilament yarn, such as smooth monofilament yarn, or a multifilament yarn, such as textured twisted multifilament yarn. Similarly, the bottom layer 16 may also comprise a monofilament yarn, such as smooth monofilament yarn, or a multifilament yarn, such as textured twisted multifilament yarn. Similarly, the middle layer 15 may be formed at least in part of monofilament yarn or multifilament yarn.

One or more of the top layer 14, the middle layer 15, and the bottom layer 16 may further include natural fibers and/or be at least partially formed from natural fibers, as described above. The natural fibers may be, for example, animal hair fibers, wool fibers, cotton fibers, hemp fibers, eucalyptus fibers, bamboo fibers, linen fibers, wood fibers, viscose fibers, flax fibers, silk fibers, plant fibers, or a combination thereof. Such natural fibers may be characterized, for example, by increased sustainability, odor neutrality, skin compatibility, durability and/or robustness compared to synthetic fibers.

The upper layer 14 further comprises a fine knit structure 17 on the outer side 11, which gives the surface a soft feel.

With regard to thickness, the upper layer 14 in the advantageous embodiment shown is dimensioned in such a way that it occupies at least 70% to 80% of the total thickness of the cover fabric 5, in order to utilize the microclimatic advantages of the weft-knitted fabrics 10 to the greatest possible extent.

In order to allow the greatest possible air circulation and optimum moisture removal to the outer side 11, the honeycomb-like recesses 12 extend essentially through the thickness of the upper layer 14 and the middle layer 15 to adjacent to the lower layer 16, so that the cover fabric simultaneously exhibits a high degree of flexibility and stretchability in width due to the recesses 12. The elasticity in height results in softness, which can be defined by the filler of the middle layer 14 depending on the desired degree of softness.

It is understood that, depending on the application, the cover fabric 5 may be produced using any known spacer knitting process as well as any known finishing process, such as a washing, bleaching and shrinking process following the knitting process. Optionally, the mattress cover 204 may be at least partially coated, rubberized, and/or provided with latex to prevent water penetration.

Figure 9A:
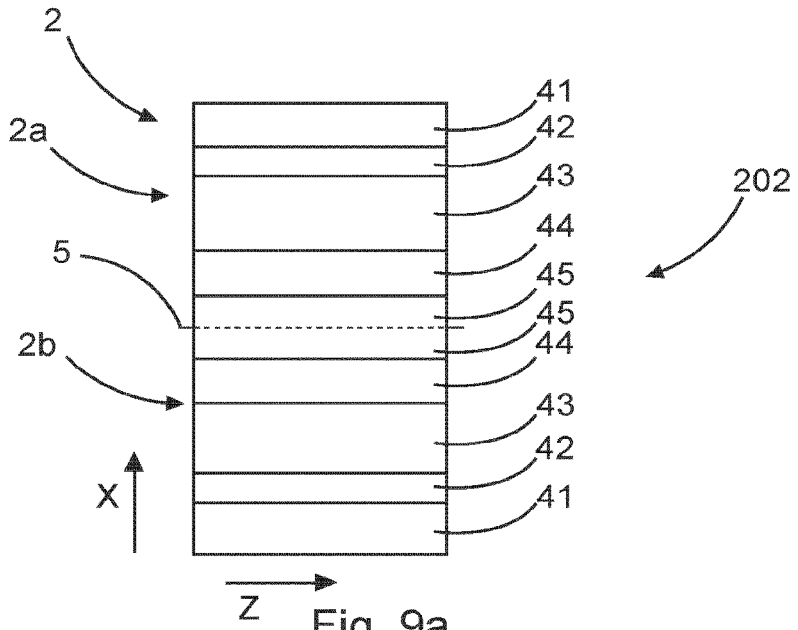
FIG. 9*a* shows a top view of a mattress and/or a first mattress element of a mattress for a reclining furniture according to an exemplary embodiment.
Figure 9B:
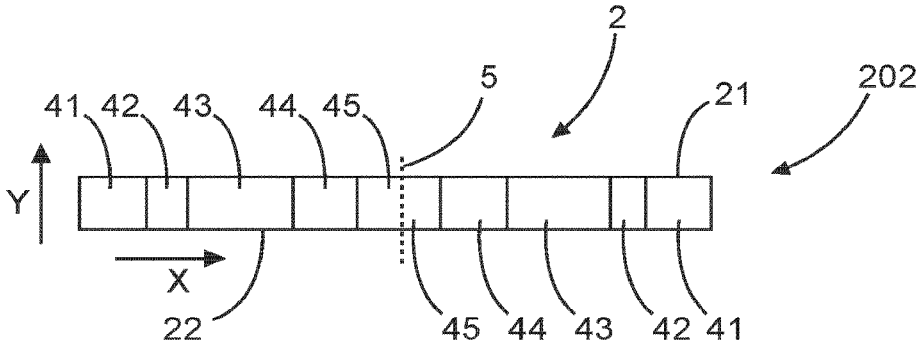
FIG. 9*b* schematically shows a cross-section of the first mattress element of a mattress of FIG. 9*a* without transverse grooves.
Figure 9C:
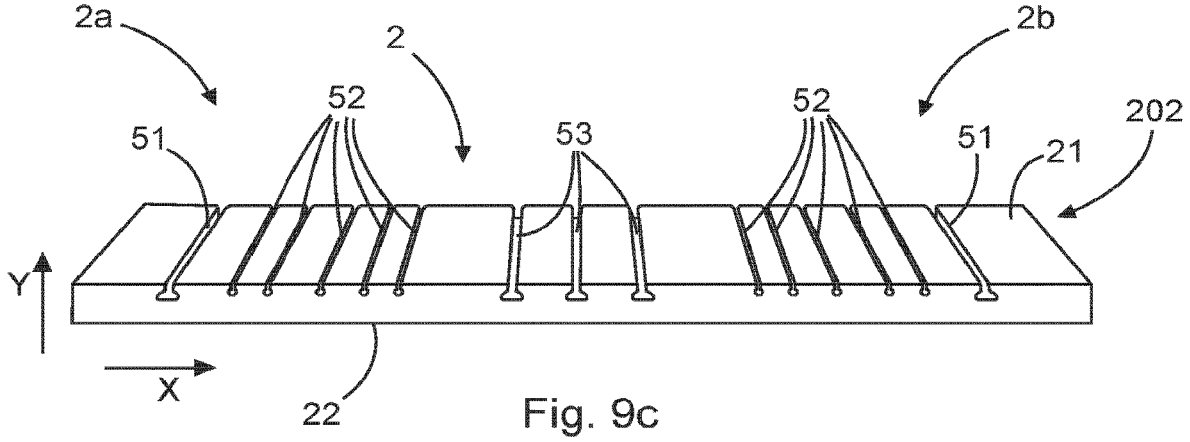
FIG. 9*c* shows a side view of the first mattress element of a mattress of FIGS. 9*a* and 9*b* with multiple transverse grooves.
Figure 9D:
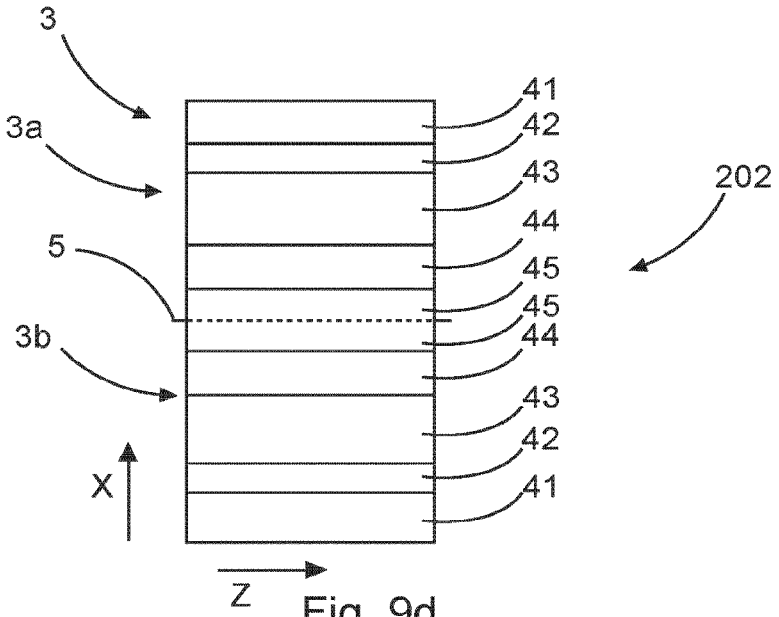
FIG. 9*d* shows a top view of a second mattress element of a mattress for a reclining furniture according to an exemplary embodiment.
Figure 9E:
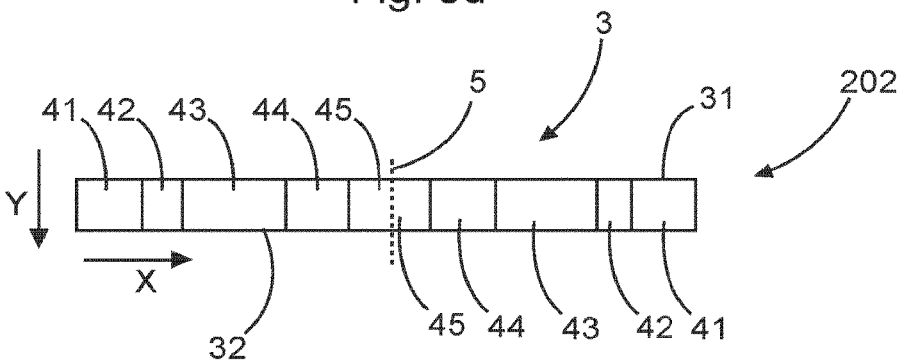
FIG. 9*e* shows a cross-section of the second mattress element of a mattress of FIG. 9*d* without transverse grooves.
Figure 9F:
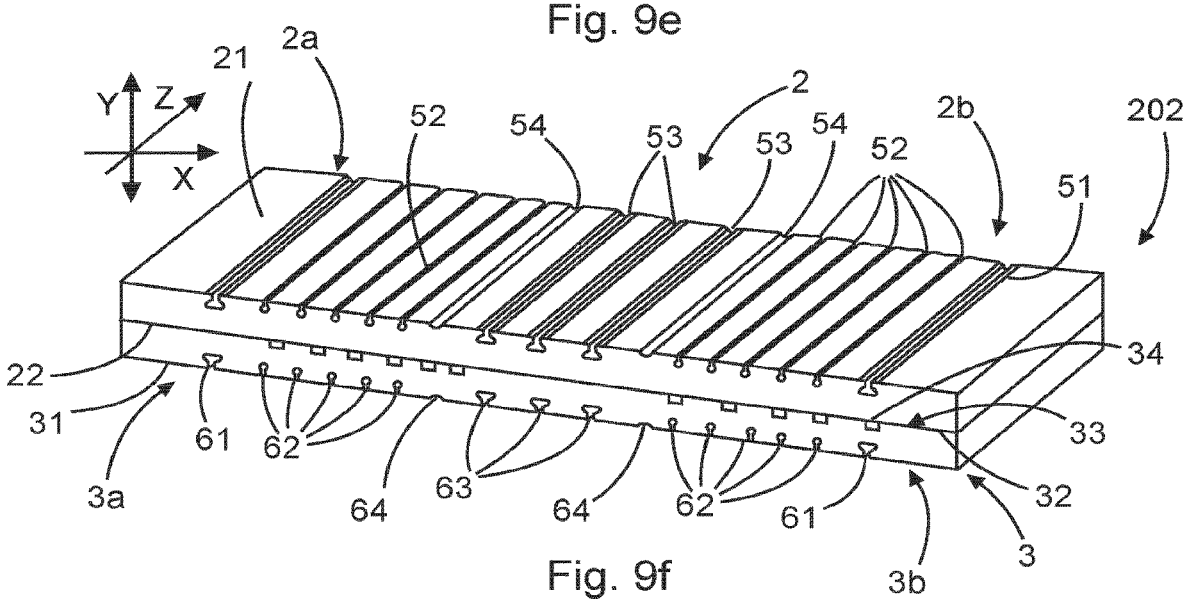
FIG. 9*f* shows a mattress of a reclining furniture according to an exemplary embodiment.

FIGS. 9*a* to 9*f* each show parts of a mattress 202 of a reclining furniture 200 according to exemplary embodiments. FIG. 9*a* shows a top view of a first mattress element 2 of a mattress 202 of a reclining furniture 200. The mattress 202 of FIGS. 9*a* to 9*f* may be combined with any of the preceding aspects of the reclining furniture 200, or individual aspects may be interchanged. FIG. 9*b* schematically shows a cross-sectional view of the first mattress element 2 of FIG. 9*a*, wherein the first mattress element 2 is shown without transverse grooves in FIGS. 9*a* and 9*b*. FIG. 9*c* shows a side view of the first mattress element 2 of FIGS. 9*a* and 9*b* with multiple transverse grooves. FIG. 9*d* shows a top view of a second mattress element 3 according to an embodiment of the disclosure. FIG. 9*e* shows a cross-section of the second mattress element 3 of FIG. 9*d* without transverse grooves. FIG. 9*f* shows a mattress 202 or a combination mattress 202 of the reclining furniture 200 according to an embodiment of the disclosure. The mattress 202 of FIG. 9*f* thereby comprises the first mattress element 2 described with reference to FIGS. 9*a* to 9*c* and the second mattress element 3 described with reference to FIGS. 9*d* and 9*e*.

The first mattress element 2 comprises a first outer surface 21 and an oppositely arranged first contact surface 32. The first outer surface 21 is thereby formed as a first lying surface 21 for the user. The second mattress element 3 comprises a second outer surface 31 and an oppositely arranged second contact surface 32. The second outer surface 31 is thereby optionally formed as a second lying surface 31 for the user. The first and second mattress elements 2, 3 are stacked on top of each other such that the first and second contact surfaces 22, 32 are at least partially in contact with each other.

For ergonomic and comfortable accommodation of the user, the two mattress elements 2, 3 and/or the mattress 202 and/or the reclining furniture 200 each comprise a plurality of support regions 41, 42, 43, 44, 45. The support areas 41, 42, 43, 44, 45 may thereby comprise a head support area 41, a neck support area 42, a shoulder support area 43, a lordosis support area 44 and a pelvis support area 45.

The mattress 202 comprises a longitudinal direction x (107 in FIGS. 1*a* to 3) or longitudinal axis x that is parallel to a longitudinal side of the mattress 202, a transverse direction z (109 in FIGS. 1*a* to 3) or transverse axis z that is parallel to a transverse side of the mattress z, and a vertical axis y that is transverse and/or orthogonal to the longitudinal direction x and the transverse direction z. A length of the mattress 202 of the reclining furniture 200 is dimensioned in the longitudinal direction, a width of the mattress 202 is dimensioned in the transverse direction z, and a thickness or height of the mattress is dimensioned along the vertical axis y. The length of the mattress 202 may be greater than or equal to the width of the mattress 202. The first mattress element 2 and the second mattress element 3 may comprise identical or different heights and/or thicknesses. The x-direction may thereby run parallel to the longitudinal axis 107 of the base element 100 and/or the reclining furniture 200. Alternatively or additionally, the z-direction can run parallel to the transverse axis 109 of the base element 100 and/or the reclining furniture 200.

Furthermore, the mattress 202 of the reclining furniture 200 comprises a central transverse axis 5 and/or a central transverse plane 5, which runs parallel to the transverse direction z and is arranged centrally between two ends of the mattress 202 that are opposite one another in the longitudinal direction x. The central transverse axis 5 and/or the central transverse plane 5 separate the first mattress element 2 into a first half 2*a* and a second half 2*b*. The central transverse axis 5 and/or the central transverse plane 5 thereby separates the first mattress element 2 into a first half 2*a* and a second half 2*b*. Similarly, the central transverse plane 5 and/or the central transverse axis 5 separates the second mattress element 3 into a first half 3*a* and a second half 3*b*.

Each of the halves 2*a*, 2*b*, 3*a*, 3*b* of the first and second mattress elements 2, 3 thereby comprises the support areas 41, 42, 43, 44, 45. The support areas 41, 42, 43, 44, 45 are thereby arranged mirror-symmetrically to the central transverse axis 5. The individual support regions 41, 42, 43, 44, 45 can thereby differ from one another at least in part with regard to a degree of hardness, a hardness, a compression hardness and/or an elasticity. For example, the supporting regions 41, 42, 43, 44, 45 can at least partially comprise a profile, profiling and/or structuring that differs from one another, for example in the form of transverse grooves 51, 52, 53, 54 formed in the respective supporting regions 41, 42, 43, 44, 45. The transverse grooves 51, 52, 53, 54 can thereby be formed in the first and/or second outer surface 21, 31 and extend over the entire width of the mattress 200 in the transverse direction z. In order to adapt the hardness of the individual support areas 41, 42, 43, 44, 45, profiles and/or the transverse grooves 51, 52, 53, 54 in the respective support areas 41, 42, 43, 44, 45 may differ from one another in terms of their cross-section, their geometry, their shape, their number, their depth dimensioned along the vertical axis y and/or their thickness or size dimensioned along the longitudinal direction x.

As can be seen in FIG. 9*c*, the first mattress element 2 comprises a single first transverse groove 51 in each of the two halves 2*a*, 2*b*, which separates the head support area 41 from the neck support area 42. The first transverse groove 51 has a T-shaped cross-section.

Furthermore, the first mattress element 2 comprises in each of the two halves 2*a*, 2*b* in the shoulder support region 43 a total of five second transverse grooves 52, which each have a round, oval, elliptical and/or drop-shaped cross-section. A geometry, width, dimension, size, thickness and/or a diameter of the five second transverse grooves 52 in the shoulder support regions 43 of the two halves 2*a*, 2*b* of the first mattress element 2 are identical. The neck support regions 42 of the first mattress element 2 are separated by one of the second transverse grooves 52 from the shoulder support regions 43 respectively adjacent to the neck support regions 42. Likewise, the lordosis support regions 44 adjacent to the shoulder support regions 43 in the direction of the central transverse axis 5 are separated from the respective shoulder support region 43 by one of the second transverse grooves 52. Furthermore, the lordosis support areas 44 are each separated from the adjacent pelvic support areas 45 by a third transverse groove 53. A total of three third transverse grooves 53 are formed in the two pelvic support regions 45 adjacent to each other at the central transverse axis 5, each of which has a T-shaped and/or triangular cross-section. The three third transverse grooves 53 thereby comprise identical geometries, widths, dimensions, sizes, thicknesses and/or diameters. The middle one of the three third transverse grooves 53 can thereby run in the center transverse plane 5 and define a boundary between the first half 2*a* and the second half 2*b*.

As shown in FIG. 9*f*, at least one additional transverse groove 54 may be formed in each of the lordosis support regions 44, which may have a circular and/or oval cross-section, for example.

As can be seen in FIG. 9*f*, the first mattress element 2 has no profile, profiling and/or structuring on its first contact surface 22. In other words, the first contact surface 22 is configured to be completely flat. Optionally, however, a profile can also be formed on the first contact surface 22 at least in a partial area. Conceivable here are any cross-sectional profiles for transverse grooves, such as round, oval, elliptical, triangular, square, polygonal, trapezoidal or the like, as explained above and below.

As can be seen in FIG. 9*f*, the second mattress element 3 comprises a single first transverse groove 61 in each of the two halves 3*a*, 3*b*, which separates the head support area 41 from the neck support area 42. The first transverse groove 61 is thereby configured analogously to the first transverse groove 51 of the first mattress element 2 and has a T-shaped cross-section. Furthermore, the second mattress element 3 comprises a total of five second transverse grooves 62 in each of the two halves 3*a*, 3*b* in the shoulder support region 43, which each have a round, oval, elliptical and/or drop-shaped cross-section. The second transverse grooves 62 of the second mattress element 3 are thereby configured analogously to the second transverse grooves 52 of the first mattress element, but a width, dimension, size, thickness and/or diameter of the five second transverse grooves 62 in the shoulder support regions 43 of the two halves 3*a*, 3*b* of the second mattress element 3 continuously decrease in the direction of the central transverse axis 5. The neck support regions 42 of the second mattress element 3 are separated from the shoulder support regions 43 respectively adjacent to the neck support regions 42 by one of the second transverse grooves 62. Similarly, the lordosis support regions 44 adjacent to the shoulder support regions 43 in the direction of the central transverse axis 5 are separated from the respective shoulder support region 43 by one of the second transverse grooves 62. Furthermore, the lordosis support regions 44 are each separated from the adjacent pelvic support regions 45 by a third transverse groove 63. A total of three third transverse grooves 63 are formed in the two pelvic support regions 45 adjacent to one another at the central transverse axis 5, which are configured analogously to the transverse grooves 53 of the first mattress element 2 and which each have a T-shaped and/or triangular cross section. The three third transverse grooves 63 thereby comprise identical geometries, widths, dimensions, sizes, thicknesses and/or diameters. The middle one of the three third transverse grooves 63 can thereby run in the center transverse plane 5 and define a boundary between the first half 3*a* and the second half 3*b*. Furthermore, analogous to the further transverse groove 54 of the first mattress element, at least one further transverse groove 64 may be formed in each of the lordosis support regions 44 of the second mattress element 3, which may, for example, have a round and/or oval cross-section.

The transverse grooves 61, 62, 63, 64 of the second mattress element 3 are arranged opposite the transverse grooves 51, 52, 53, 54 of the first mattress element 2 and formed on the second outer surface 32 of the second mattress element 3. Furthermore, the two halves 2*a*, 2*b* of the first mattress element 2 and the two halves 3*a*, 3*b* of the second mattress element 3 are configured to be completely mirror-symmetrical with respect to the central transverse axis 5 or central transverse plane 5.

As shown in FIG. 9*f*, the second mattress element 3 comprises a profile 33 at its second contact surface 32, which profile comprises a plurality of transverse grooves 34. The transverse grooves 34 are exemplarily shown with a rectangular cross-section. Any other cross-sections are conceivable.

Also, the profile 33 may be wave-shaped with multiple wave crests and wave troughs. Alternatively or additionally, the profile 33 or another profile may be introduced in the contact surface 22 of the first mattress element 2. Also, profiles and/or transverse grooves may be introduced into both contact surfaces, which may at least partially interlock.

Exemplary transverse grooves for the first outer surface, the second outer surface, the first contact surface and/or the second contact surface are shown in the following figures.

FIGS. 10 to 13 each show exemplary transverse grooves of a mattress 202 of a reclining furniture according to an exemplary embodiment. In particular, longitudinal sections through the respective mattress 202 are shown.

Figure 10:
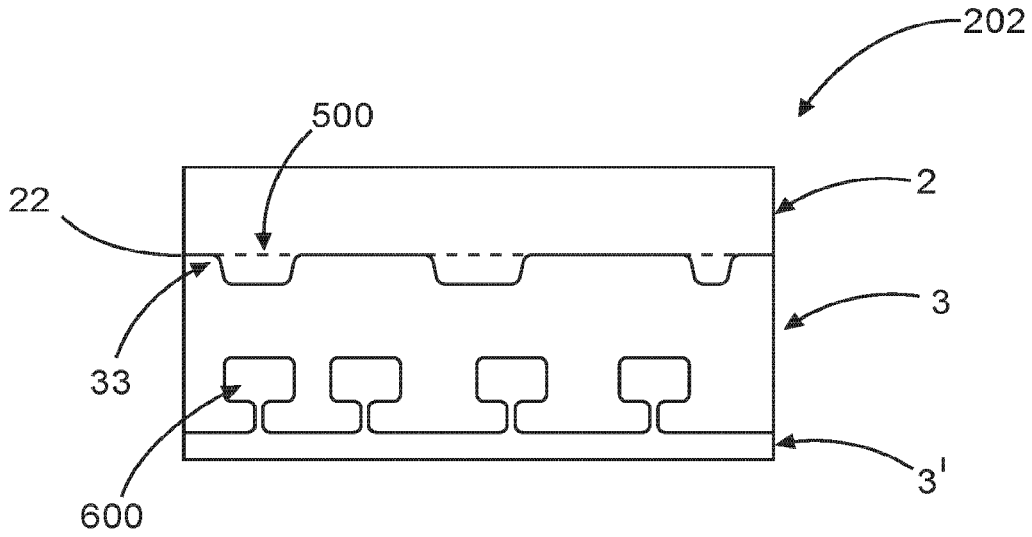
FIGS. 10 to 13 each show exemplary transverse grooves of a mattress of a reclining furniture according to an exemplary embodiment.

The mattress 202 of FIG. 10 has a total of three parts, comprising three mattress elements 2, 3, 3'. In contrast, the mattresses 202 of FIGS. 11 to 13 comprise only two mattress elements 2, 3. However, more or fewer mattress elements can be provided as desired.

The transverse grooves and/or profiles shown in FIGS. 10 to 13 are arranged only schematically and exemplarily on the contact or outer surfaces of the mattress elements 2, 3, 3' shown there. However, the transverse grooves and/or profiles may also be arranged on any other surfaces of the mattress 202.

In the example in FIG. 10, the first mattress element 2 does not comprise a profile or transverse grooves. The second mattress element 3 comprises trapezoidal transverse grooves 500 on the contact surface 33 and rectangular transverse grooves 600 on a side or surface opposite this contact surface 33, which are recessed and/or introduced into the second mattress element 3 at a distance from this surface. A further mattress element 3' without profile forms the further outer surface of the mattress 202.

Figure 11:
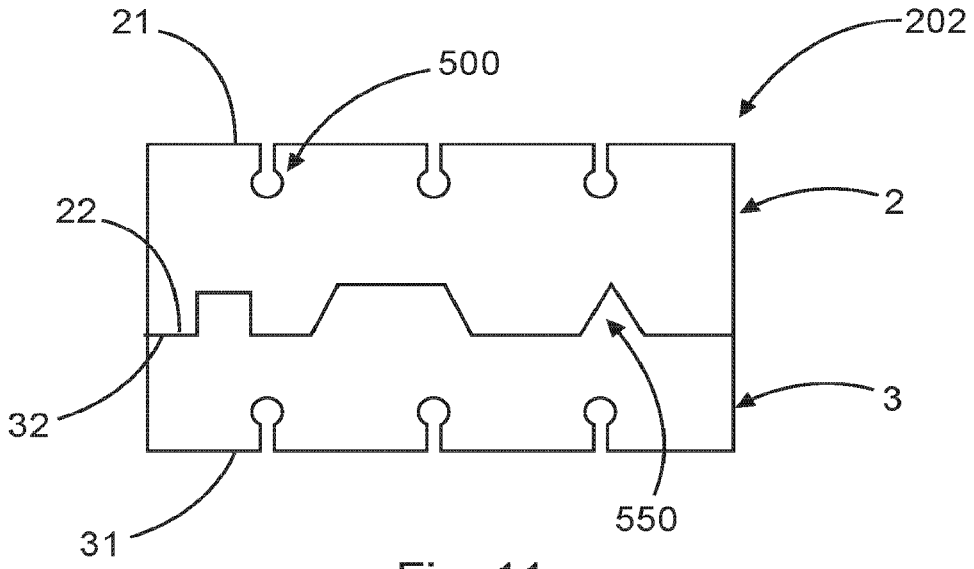

In the example of FIG. 11, the first mattress element 2 comprises transverse grooves 500 with a round cross-section on the outer surface 21 and transverse grooves 550 with a rectangular, trapezoidal or triangular cross-section on the contact surface 22. The second mattress element 3 has transverse grooves 600 with a round cross-section only on the outer surface 31 and the contact surface 32 has no profile.

Figure 12:
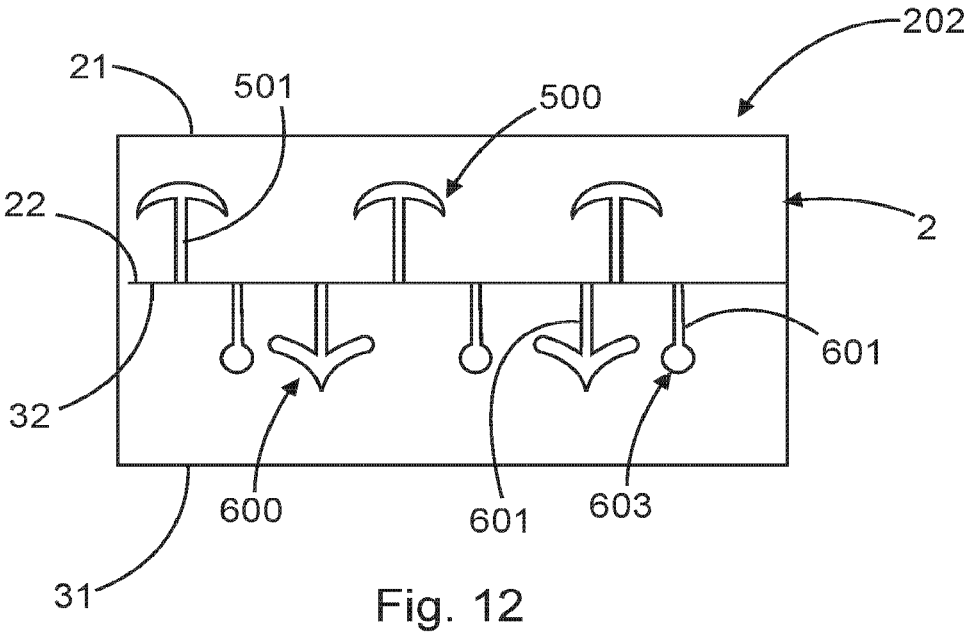

In FIG. 12, the first mattress element 2 comprises bean-shaped transverse grooves 500 which are introduced into the first mattress element via incisions 501 from the first contact surface 21 such that the transverse grooves 500 are arranged closer to the first outer surface 21 of the first mattress element 2 than to the first contact surface 22 of the first mattress element 2. Similar transverse grooves 600 with incisions 601 are introduced into the second mattress element 3 via the second contact surface 32. In this regard, the transverse grooves 600 are shaped in a boomerang shape, a coat hanger shape, and/or a triangular shape. Further, additional transverse grooves 603 having a circular cross-section are introduced in the second mattress element 3. The second outer surface 31 of the second mattress element 3 has no profile.

Figure 13:
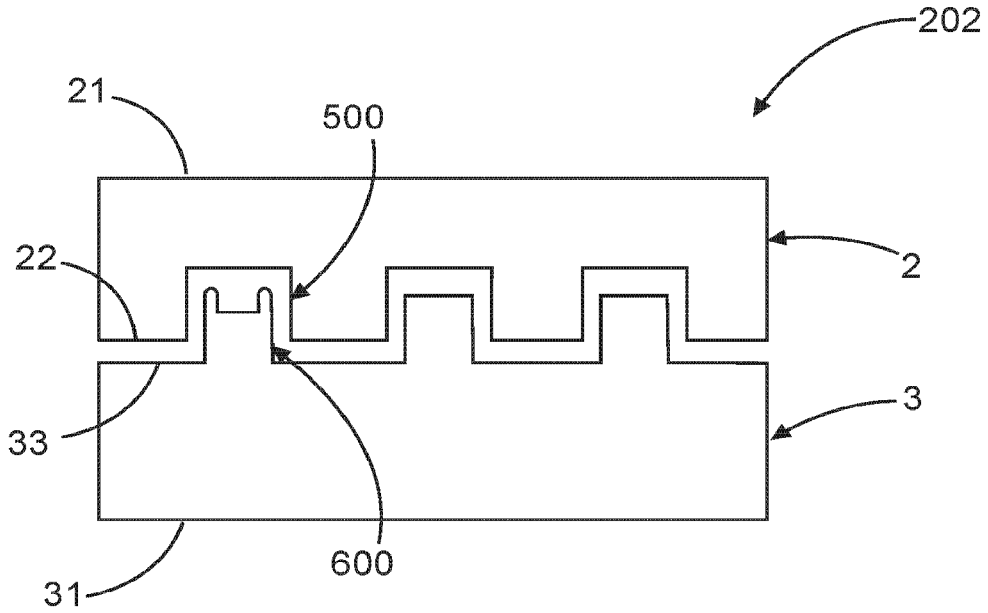

In the example shown in FIG. 13, the first mattress element 2 and the second mattress element 3 have profiles and/or transverse grooves 500, 600 corresponding to one another on their contact surfaces 22, 32, which at least partially interlock in a tooth-like manner. The outer surfaces 21, 31 of the two mattress elements 2, 3 have no profiles.

Supplementally, it should be noted that "including" and "comprising" do not exclude other elements, and "one" or "a" do not exclude a plurality. It should further be noted that features described with reference to any of the above exemplary embodiments may also be used in combination with other features of other exemplary embodiments described above. Reference signs in the claims are not to be regarded as limitations.

The invention claimed is:

1. A base element configured to deform a mattress and/or reclining furniture, comprising:

a frame element formed of elastically deformable material, in particular of foam material, comprising a bottom surface on a first side and comprising a second side opposite to the first side, wherein the frame element comprises a compartment on the second side;

an elastically deformable cover layer, wherein the cover layer is arranged on the second side of the frame element so that the compartment is bounded by the cover layer, and wherein the cover layer forms a support surface for a mattress arranged opposite the bottom surface; and an adjustment device arranged in the compartment of the frame element, wherein the adjustment device comprises at least one drive as well as a drive mechanism coupled to the drive and is configured to deform the base element and/or the mattress placed on the base element at least in certain areas, wherein the drive mechanism comprises at least two rails which are arranged substantially parallel to a longitudinal axis of the base element and which are spaced apart from each other parallel to a transverse axis of the base element by at least one transverse strut, wherein each of the at least two rails comprises at least two rail elements, which are arranged parallel to the longitudinal direction one behind the other and are coupled to each other via at least one joint, so that the at least two rail elements of each rail are displaceable relative to each other via the at least one drive, wherein at least one longitudinal support strut is arranged on each of the least two rails for extending the respective rail, and wherein the at least one longitudinal support strut is formed of a different material as the respective rail.

2. The base element according to claim 1, wherein the adjustment device further comprises a control circuitry configured to actuate or control the drive.

3. The base element according to claim 1, wherein the adjustment device is configured to be waterproof.

4. The base element according to claim 1, wherein the adjustment device further comprises an energy storage device configured to supply electrical energy to the adjustment device.

5. The base element according to claim 1, wherein the adjustment device comprises a plurality of drives or comprises a plurality of drive mechanisms.

6. The base element according to claim 1, wherein the adjustment device comprises at least one interface configured to receive and transmit a control signal, wherein the at least one drive is further configured to deform the base element and/or the mattress placed on the base element based on the control signal, at least in certain areas, and/or wherein control circuitry is further configured to control and/or actuate the drive based on the control signal.

7. The base element according to claim 6, wherein the at least one interface is a wireless interface configured to wirelessly receive and/or transmit a control signal.

8. The base element according to claim 1, further comprising:

an operating device configured to send and receive a control signal wirelessly to and from the at least one drive or a control circuitry of the adjustment device.

9. The base element according to claim 1, wherein the drive mechanism coupled to the at least one drive comprises at least one pulley mechanism and/or at least one gear mechanism.

10. The base element according to claim 9, wherein the at least one pulley mechanism and/or gear mechanism is integrated into at least one of the at least two rails and/or the at least one cross member.

11. The base element according to claim 1, wherein the longitudinal support struts arranged on each of the two rails are coupled to and/or spaced apart from each other via at least one transverse support strut.

12. The base element according to claim 1, wherein the at least one drive is arranged on one of the at least two rails and is coupled via at least one shaft to at least one further rail arranged opposite.

13. The base element according to claim 1, wherein each of the at least two rails comprises at least three rail elements, which are arranged one behind the other parallel to the longitudinal direction and are coupled to each other in pairs via at least one joint, so that the base element is deformable in at least three partial regions.

14. The base element according to claim 1, further comprising:

a base cover which encloses the base element and which is configured in particular to prevent the mattress placed on the base element from slipping.

15. The base element according to claim 14, wherein the base cover is formed at least in part from a rubber-like material; and/or wherein the base cover is rubberized, and/or wherein the base cover is formed of latex.

16. A reclining furniture, comprising:

a base element according to claim 1;

the mattress which is placed with a first side on the cover layer of the base element so that the mattress is configured to be deformed at least in one or more areas by deforming the base element with the adjustment device, and wherein the mattress comprises a second side opposite the first side, which forms a lying surface of the reclining furniture.

17. The reclining furniture according to claim 16, further comprising:

at least one reclining furniture cover which encloses the base element and the mattress.

18. The reclining furniture according to claim 16, wherein the at least one reclining furniture cover is formed as a mattress cover, and wherein the mattress cover and/or a cover fabric of the mattress cover is formed from a weft-knitted fabrics.

19. The reclining furniture according to claim 18, wherein the mattress cover comprises the cover fabric having at least an upper layer and a lower layer, wherein the upper layer and the lower layer are arranged one above the other, wherein at least the upper layer of the cover fabric is formed from a weft-knitted fabric including a weft-knitted 3D spacer fabric, and wherein a plurality of recesses s formed at least on an outer side of the upper layer facing away from the lower layer.

20. The reclining furniture according to claim 19, wherein the recesses are arranged regularly and/or in a regular pattern.

21. The reclining furniture according to claim 19, wherein the recesses are formed in a shape of honeycombs, and/or wherein the recesses comprise a round, a rounded, an angular, a square, a rectangular, a polygonal, a triangular, an elliptical, an oval and/or a polygonal cross-section.

22. The reclining furniture according to claim 16, wherein recesses extend at least substantially through a thickness of a top layer and optionally a middle layer of a cover fabric.

* * * * *